US012751522B2

(12) United States Patent
Pollack et al.

(10) Patent No.: US 12,751,522 B2
(45) Date of Patent: Oct. 6, 2026

(54) REEL BASED CLOSURE DEVICE

(71) Applicant: BOA Technology, Inc., Denver, CO (US)

(72) Inventors: Thomas Pollack, Golden, CO (US); Randon Kruse, Denver, CO (US); Eric Irwin, Denver, CO (US); Daniel Hipwood, Englewood, CO (US); Mark Clementi, Denver, CO (US); Brendan Hoskens, Denver, CO (US); Erik Suomi, Denver, CO (US); Charles Clayton Corbett, Denver, CO (US); Geoff Gloceri, Denver, CO (US); Ryan Wesson, Denver, CO (US); Eric Whewell, Denver, CO (US); Jeffrey Gay, Denver, CO (US); Taylor James DiTallo, Denver, CO (US); Cody Henderson, Denver, CO (US); Erik Anders Swanson, Denver, CO (US); Tyler Ziebelman, Denver, CO (US); John Coe, Denver, CO (US); Stephen Evans, Denver, CO (US)

(73) Assignee: BOA Technology, Inc., Denver, CO (US)

( * ) Notice: Subject to any disclaimer, the term of this patent is extended or adjusted under 35 U.S.C. 154(b) by 178 days.

(21) Appl. No.: 18/412,054

(22) Filed: Jan. 12, 2024

(65) Prior Publication Data

US 2024/0375910 A1 Nov. 14, 2024

Related U.S. Application Data

(60) Provisional application No. 63/510,550, filed on Jun. 27, 2023, provisional application No. 63/438,720, filed on Jan. 12, 2023.

(51) Int. Cl.
*A43C 11/16* (2006.01)
*B65H 75/44* (2006.01)

(52) U.S. Cl.
CPC ..... *A43C 11/165* (2013.01); *B65H 75/4471* (2013.01); *B65H 75/4492* (2013.01); *B65H 2403/47* (2013.01); *B65H 2403/481* (2013.01)

(58) Field of Classification Search
CPC ... A43C 11/16; A43C 11/165; B65H 75/4481; B65H 75/4492; B65H 75/40;
(Continued)

(56) References Cited

U.S. PATENT DOCUMENTS 4,748,726 A * 6/1988 Schoch ..... A43C 11/16 24/68 B
5,042,177 A * 8/1991 Schoch ..... A43C 11/165 36/50.1

(Continued)

FOREIGN PATENT DOCUMENTS

CN 112660944 B * 9/2023 ..... A43C 11/165
CN 117652753 A * 3/2024 ..... A43C 11/165

(Continued)

*Primary Examiner* — Victoria P Augustine
*Assistant Examiner* — Raveen J Dias
(74) *Attorney, Agent, or Firm* — Kilpatrick Townsend & Stockton LLP; Clark F. Weight

(57) ABSTRACT

A reel based closure device for tensioning a tension member is described herein. The reel based closure device includes a housing that defines a vertical axis, a plurality of teeth operably coupled with the housing, a spool rotatably positioned within the housing, and an engagement member comprising one or more teeth that engage with the plurality of teeth during a rotation of the spool. A dial or knob is operably coupled with the spool so that a rotation of the dial or knob effects the rotation of the spool to wind the tension member about the spool. A length of each tooth that is
(Continued)

operably coupled with the housing is substantially longer than a length of each tooth of the engagement member.

14 Claims, 24 Drawing Sheets

(58) Field of Classification Search
CPC ..... B65H 75/406; B65H 75/4428; B65H 75/4442; B65H 75/4471; B65H 2403/47; B65H 2403/48; B65H 2403/4481; B65H 2701/30; B65H 2403/481; F16H 1/28; F16H 1/2809; F16H 1/2818; F16H 1/2827; F16H 1/2845; F16H 1/48
See application file for complete search history.

(56) References Cited

U.S. PATENT DOCUMENTS 5,600,874 A * 2/1997 Jungkind ..... A43C 11/165 24/71 SK
8,157,691 B2 * 4/2012 Stanovskoy ..... F16H 1/32 475/180
9,285,776 B1 * 3/2016 Custer ..... A44C 5/022
9,681,705 B2 6/2017 Trudel et al.
10,100,975 B2 * 10/2018 Chen ..... B62J 15/02
10,617,546 B2 * 4/2020 Turrini ..... A61F 5/0111
11,266,206 B2 * 3/2022 Chen ..... A43C 11/165
11,806,264 B2 * 11/2023 Miller ..... A61F 5/0125
12,108,843 B2 * 10/2024 Chen ..... A43C 11/165
12,116,238 B2 * 10/2024 Huang ..... A43C 11/165
12,137,773 B2 * 11/2024 Chen ..... B65H 75/4455
12,144,757 B2 * 11/2024 Miller ..... A61F 5/0125
12,317,964 B2 * 6/2025 Chen ..... A43B 13/04
2006/0156517 A1 * 7/2006 Hammerslag ..... A43C 11/00 24/68 SK
2008/0060167 A1 * 3/2008 Hammerslag ..... A43C 11/165 24/714.6
2010/0139057 A1 * 6/2010 Soderberg ..... B65H 75/4434 242/396.2
2010/0299959 A1 * 12/2010 Hammerslag ..... A43C 11/165 36/50.5
2013/0092780 A1 * 4/2013 Soderberg ..... A43C 11/165 242/397
2015/0076272 A1 * 3/2015 Trudel ..... A43C 11/165 242/381.4
2015/0250268 A1 * 9/2015 Alt ..... A43C 11/165 24/68 SK
2015/0308188 A1 * 10/2015 Lin ..... E06B 9/56 242/375.3
2015/0313319 A1 * 11/2015 Ha ..... A43C 11/165 24/712
2016/0066653 A1 * 3/2016 Piva ..... A43C 7/00 248/332
2016/0120267 A1 * 5/2016 Burns ..... A43C 11/165 24/68 C
2017/0027287 A1 * 2/2017 Burns ..... A43C 11/20
2017/0082242 A1 * 3/2017 Chen ..... B62J 15/02
2017/0295888 A1 * 10/2017 Chen ..... A43C 11/165
2017/0304102 A1 * 10/2017 Turrini ..... A61F 5/01
2017/0325548 A1 * 11/2017 Ha ..... A43C 11/165
2019/0300309 A1 * 10/2019 Takahashi ..... B65H 5/06
2020/0069002 A1 * 3/2020 Fiedler ..... A42B 3/145
2020/0189158 A1 6/2020 Hipwood et al.
2020/0268108 A1 * 8/2020 Fiedler ..... A43C 11/165
2020/0337418 A1 * 10/2020 Chen ..... B65H 75/4494
2020/0346888 A1 * 11/2020 Kruse ..... A43B 23/0205
2020/0369073 A1 * 11/2020 Cemke, Jr. ..... B65H 75/406
2021/0037926 A1 * 2/2021 Kim ..... A43C 7/08
2021/0127795 A1 * 5/2021 Chen ..... A43C 11/06
2021/0284483 A1 * 9/2021 Chen ..... A43C 11/165
2021/0368741 A1 * 12/2021 Duffin ..... A01K 27/004
2022/0142304 A1 * 5/2022 Chen ..... B65H 75/4421
2022/0175089 A1 * 6/2022 Pollack ..... A43C 11/165
2022/0234862 A1 * 7/2022 Hurley ..... A43C 11/165
2023/0092419 A1 * 3/2023 Chen ..... A43C 11/165 24/712.2
2023/0248116 A1 * 8/2023 Duller ..... A43C 11/165 24/68 SK
2024/0008598 A1 * 1/2024 Chen ..... A43B 1/04
2024/0035546 A1 * 2/2024 Tasi ..... F16G 11/12
2024/0065382 A1 * 2/2024 Jungkind ..... A45C 13/10
2024/0382321 A1 * 11/2024 Wood ..... A43C 11/165
2024/0423327 A1 * 12/2024 Chen ..... A43C 11/008
2025/0024916 A1 * 1/2025 Chen ..... B65H 75/4494

FOREIGN PATENT DOCUMENTS

FR 3051334 A1 * 11/2017 ..... A45C 13/1046
JP 6 243542 B2 12/2017
TW M507670 U * 9/2015 ..... A43C 11/165
WO WO-2021064543 A1 * 4/2021 ..... A43C 11/165

* cited by examiner

REEL BASED CLOSURE DEVICE

CROSS-REFERENCE TO RELATED APPLICATIONS

This application claims priority to Provisional U.S. Patent Application No. 63/438,720 filed Jan. 12, 2023, entitled "REEL BASED CLOSURE DEVICE" and Provisional U.S. Patent Application No. 63/510,550 filed Jun. 27, 2023, entitled "REEL BASED CLOSURE DEVICE." The entire disclosure of both of the aforementioned Provisional U.S. Patent Applications are hereby incorporated by reference, for all purposes, as if fully set forth herein.

BACKGROUND

Snow skiing, including alpine skiing, Nordic skiing and telemark skiing, is a popular winter recreational activity or sport around the world. Equipment that is used in skiing includes boots, skis and bindings that attach the boots to the skis. Ski boots, such as alpine ski boots, typically have exterior shells that are made of rigid materials, such as various rigid polymers. The exterior shells are often difficult to close about a user's leg and foot due to the rigid polymer materials that are employed. It is also often difficult to make the ski boot comfortable due to the rigid materials that are employed. A proper balance between comfort and fit is desired in ski boots, but may be difficult to achieve due the use of rigid materials and other design constraints. Conventional closure devices that are employed to close ski boots often tighten the ski boot in relatively large increments or steps, which may add a degree of complexity in achieving a proper balance between fit and comfort. Described herein are components, systems, and devices that enable quick and easy closure of ski boot, other boots, or articles of footwear. The components, systems, and devices balance comfort and fit in tightening articles of footwear about a wearer's foot. The components, systems, and devices may also be used to close and tighten various other non-footwear related articles, especially footwear that may include rigid materials or otherwise be difficult to close.

BRIEF DESCRIPTION

Described herein are components, systems, and devices that enable quick and easy closure of ski boot, snowboard boots, or other boots or articles of footwear. The components, systems, and devices balance comfort and fit in tightening articles of footwear about a wearer's foot. The components, systems, and devices may also be used to close and tighten various other non-footwear related articles.

According to one aspect, a reel based closure device for tensioning a tension member includes a housing that defines a vertical axis, a plurality of teeth that are operably coupled with the housing, a spool rotatably positioned within the housing, and an engagement member that includes one or more teeth that engage with the plurality of teeth operably coupled with the housing. The reel based closure device also includes a dial or knob that is operably coupled with the spool so that a rotation of the dial or knob effects the rotation of the spool within the housing to thereby wind the tension member about the spool. A length of each tooth of the plurality of teeth operably coupled with the housing is substantially longer than a length of each tooth of the one or more teeth of the engagement member.

In some instances, the length of each tooth of the plurality of teeth is between 30% and 60% longer than the length of each tooth of the one or more teeth of the engagement member. The engagement member may be a planetary gear of a gear mechanism and/or may be a pawl member that includes one or more pawl teeth, such as the dial core 230 described herein. The plurality of teeth that are operably coupled with the housing may be a ring gear of the gear mechanism and/or may be housing teeth that engage with pawls of the dial core. An upper flange of the spool may include an annular recess or lip that is shaped and sized to accommodate the plurality of teeth operably coupled with the housing. A bottom or distal end of the each tooth of the plurality of teeth operably coupled with the housing may extend below a bottom or distal end of each tooth of the one or more teeth of the engagement member.

According to another aspect, a method of manufacturing a reel based closure device includes providing a reel based closure device that includes a housing defining a vertical axis, a plurality of teeth operably coupled with the housing, a spool rotatably positioned within the housing, and a dial or knob that is operably coupled with the spool so that a rotation of the dial or knob effects the rotation of the spool within the housing. The method also includes positioning an engagement member in operable engagement with the plurality of teeth operably coupled with the housing. The engagement member includes one or more teeth that engage with the plurality of teeth and a length of each tooth of the plurality of teeth operably coupled with the housing is substantially longer than a length of each tooth of the one or more teeth of the engagement member.

According to another aspect, a reel based closure device for tensioning a tension member includes a housing, a spool rotatably positioned within the housing, and a dial or knob that is operably coupled with the spool so that a rotation of the dial or knob effects rotation of the spool in a tightening direction. The spool includes an annular recess around which the tension member is wound as the spool is rotated in the tightening direction within the housing. The annular recess of the spool includes a spine or ridge that separates two troughs or channels about which the tension member is wound.

Each trough or channel has a width that is approximately equal to a diameter of the tension member so that a single layer of the tension member is wound about each trough or channel. One of the troughs or channels has a diameter that is less than the other trough or channel. The troughs or channels are arranged so that as the tension member is wound about each trough or channel, the tension member in each trough or channel remains aligned with the tension member in the other trough or channel. The troughs or channels are arranged so that the tension member is wound between 170 and 200 degrees about one of the troughs or channels before the tension member is wound about the other trough or channel. The troughs or channels include a first trough or channel and a second trough or channel and neither the first trough or channel nor the second trough or channel has a circular cross section.

According to another aspect, a method of manufacturing a reel based closure device includes providing a reel based closure device having a housing and a dial or knob. The method also includes positioning a spool within the housing so that the spool is rotatable within the housing and is operably coupled with the dial or knob such that a rotation of the dial or knob effects a rotation of the spool in a tightening direction. The spool includes an annular recess around which the tension member is wound as the spool is rotated in the tightening direction and the annular recess of the spool includes a spine or ridge that separates two troughs or channels about which the tension member is wound.

According to another aspect, a reel based closure device includes a housing, a spool rotatably positioned within the housing, a tightening member rotatably coupled with the housing and operably coupled with the spool such that an operation of the tightening member causes the spool to rotate within the housing in a first direction to wind a tension member about the spool, and a central boss that protrudes axially into the interior region of the housing. The spool and/or the central boss are couplable with the reel based closure device via a one way snap member or mechanism.

In some instances, the housing includes one or more snap members that enable the spool to be axially inserted within the housing while preventing removal or retraction of the spool from the housing and/or the spool includes one or more snap members that enable the central boss to be axially inserted within the spool while preventing removal or retraction of the central boss from the spool. In the latter instance, the one or more snap members are positioned adjacent a central aperture of the spool to enable the central boss to be inserted through the spool's central aperture and to lock a bottom end of the central boss within the central aperture. These one or more snap members may be configured to flex radially outward to enable the central boss to be axially inserted within the spool. A distal end of the central boss has an axially extending gap that separates at least two axially extending members. Each axially extending member includes a radially outward extending feature.

According to another aspect, a method of manufacturing a reel based closure device includes providing a reel based closure device having a housing, a spool rotatably positioned within the housing, a tightening member rotatably coupled with the housing and operably coupled with the spool such that an operation of the tightening member causes the spool to rotate within the housing in a first direction to wind a tension member about the spool, and a central boss that protrudes axially into the interior region of the housing. The method also includes coupling the spool and/or the central boss with the reel based closure device via a one way snap member or mechanism.

According to another aspect, a reel based closure device for tensioning a tension member includes a housing, a spool rotatably positioned within the housing, and a dial or knob that is operably coupled with the spool so that a rotation of the dial or knob effects a rotation of the spool in a tightening direction to thereby wind a first end portion of the tension member and a second end portion of the tension member about the spool. The housing includes a single lace port through which the first end portion of the tension member and the second end portion of the tension member are inserted.

The single lace port includes a first opening for the first end portion of the tension member and a second opening for the second end portion of the tension member, in which the second opening is separate from the first opening. The second opening is typically positioned horizontally adjacent to the first opening and the second opening is larger than the first opening. The second opening may have an oval shape that is aligned with a vertical axis of the reel based closure device. The single lace port may be made of a different material than the housing.

According to another aspect, a method of manufacturing a reel based closure device includes providing a reel based closure device having a housing, a spool rotatably positioned within the housing, and a dial or knob that is operably coupled with the spool so that a rotation of the dial or knob effects a rotation of the spool in a tightening direction to thereby wind a first end portion of the tension member and a second end portion of the tension member about the spool. The method also includes coupling a single lace port with the housing. The first end portion of the tension member and the second end portion of the tension member are insertable through the single lace port.

BRIEF DESCRIPTION OF THE DRAWINGS

The present invention is described in conjunction with the appended figures.

Figure 1:
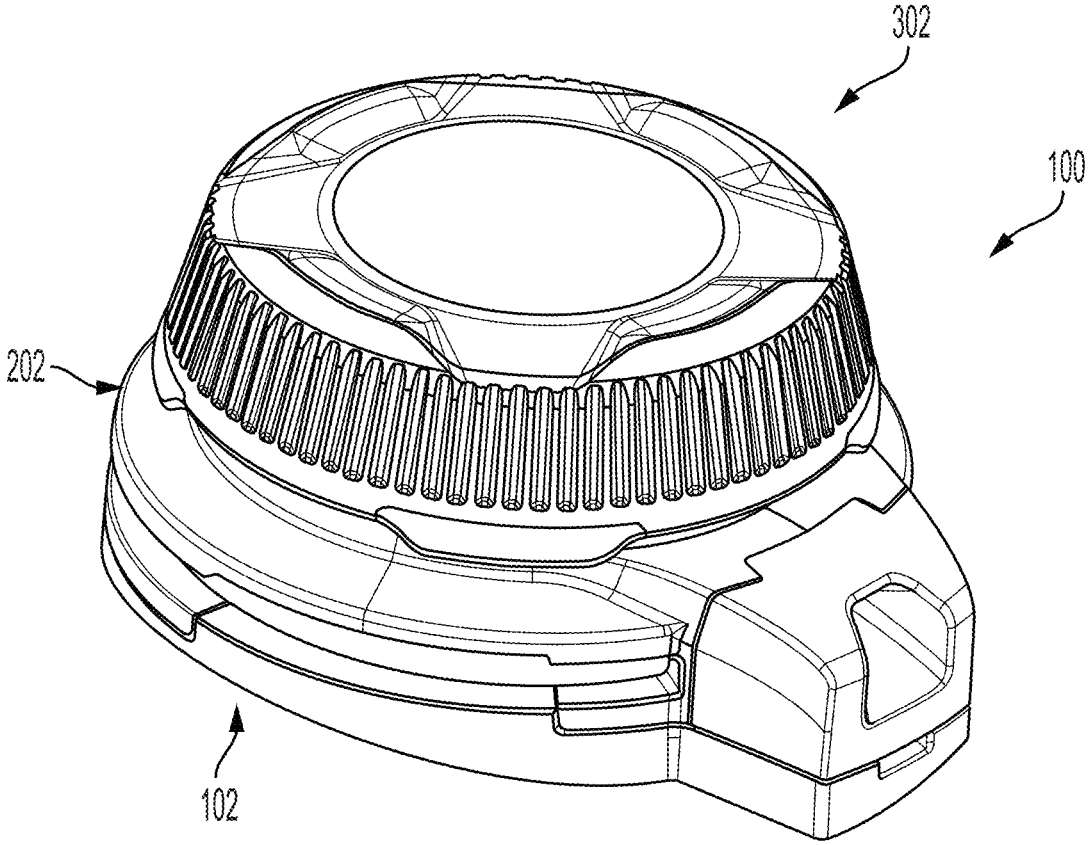
FIG. 1 illustrates an assembled perspective view of a reel based closure device.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

The embodiments herein describe reel based closure devices that are usable to close and tighten an article. The reel based closure devices may be especially useful in closing and tightening articles that require a substantial amount of lace tension. For example, alpine or ski boots (hereinafter ski boots) are typically made of rigid plastic materials that require a substantial amount of closure force to tighten about a user's foot. Conventional reel based closure devices, and other devices, may not be suited to tighten ski boots about a user's foot because the reel based closure device may not be designed to output a needed torque. In addition, the tension member or lace that is used with the ski boot may not be designed to handle the required tension.

The reel based closure devices described herein are better able to achieve high torque outputs and may be paired with a tension member or lace that is designed to withstand higher tension loads. As such, the reel based closure devices may be well suited to close and tighten articles that require substantial closure forces. In addition to tightening ski boots, the reel based closure devices may also be employed to close and tighten various other articles, such as snowboard boots, military boots, shoes, packs, bags, and the like. In addition, the reel based closure device may also be used to close and tighten various articles that do not require high levels of closure forces. In such instances, the reel based closure device may be used unmodified, or one or more components of the reel based closure device may be modified or altered to enable use for another application. For ease in describing the embodiments herein, the reel based closure device will be generally described as being used to close and/or tighten ski boots, although it should be realized that this description is equally applicable to various other articles.

The reel based closure device is typically attached to the exterior of the ski boot, such as the shell, and is used to tighten the exterior of the ski boot about a user's leg and/or foot. The reel based closure device is configured to tension a lace or tension member that is guided about the ski boot via one or more guide members, which may be rigid components that are made of plastic or other materials, such as those described herein. In other embodiments, the one or more guide members may be made of flexible or soft components, such as fabric materials.

The reel based closure device typically includes a knob or dial that may be grasped and rotated by a user. The knob or dial is commonly coupled with a spool around which the tension member or lace is wound in response to rotation of the knob or dial in a tightening direction. Rotation of the tension member or lace around the spool tensions the tension member or lace, which tightens the ski boot about a user's foot by constricting the shell and any internal components (i.e., a liner, etc.) about the user's foot.

The reel based closure device may replace traditional buckles and/or other tightening systems that are currently used on ski boots to tighten the ski boot about a user's foot. In some embodiments, the reel based closure device may be used in combination with a traditional buckle or other tightening system. Likewise, the ski boot may include multiple reel based closure devices that are arranged to close and tighten different areas or portions of the ski boot.

The reel based closure devices are significantly easier to operate than traditional buckles and/or other tightening systems. As such, user's may prefer to use a reel based closure device in tightening a ski boot. In addition, reel based closure devices may offer incremental degrees of tightening and loosening of the ski boot in comparison with traditional buckles and/or other tightening systems. For example, traditional buckles and/or other tightening systems often include a limited number of tightening segments (e.g., teeth, steps, racks, and the like) that are used in tightening the ski boot. For example, traditional buckles often employ 5 to 10 teeth on a rack within which an engagement pin is positioned to tighten the ski boot. The engagement pin is moved proximally or distally about the rack and positioned within a proximal or distal tooth in order to increase or decrease the tightness of the ski boot about the foot. The limited number of tightening segments (e.g., teeth) results in the ski boot being tightened or loosened by greater amounts or degrees and thus, it may be difficult to achieve a desired fit.

In contrast, the reel based closure device may be capable of tightening and/or loosening the ski boot by significantly smaller incremental amounts or degrees. For example, if a minor increase in tightness is desired, the knob of the reel based closure device may be rotated by a quarter turn, an eighth of a turn, or less to slightly increase the tension in the tension member. The slight increase in the tension member's tension normally results in a slight increase in the tightness or constriction of the ski boot about the user's foot. This incremental adjustment of the ski boot's tightness may allow a desired fit of the ski boot to be easily achieved.

Figure 2:
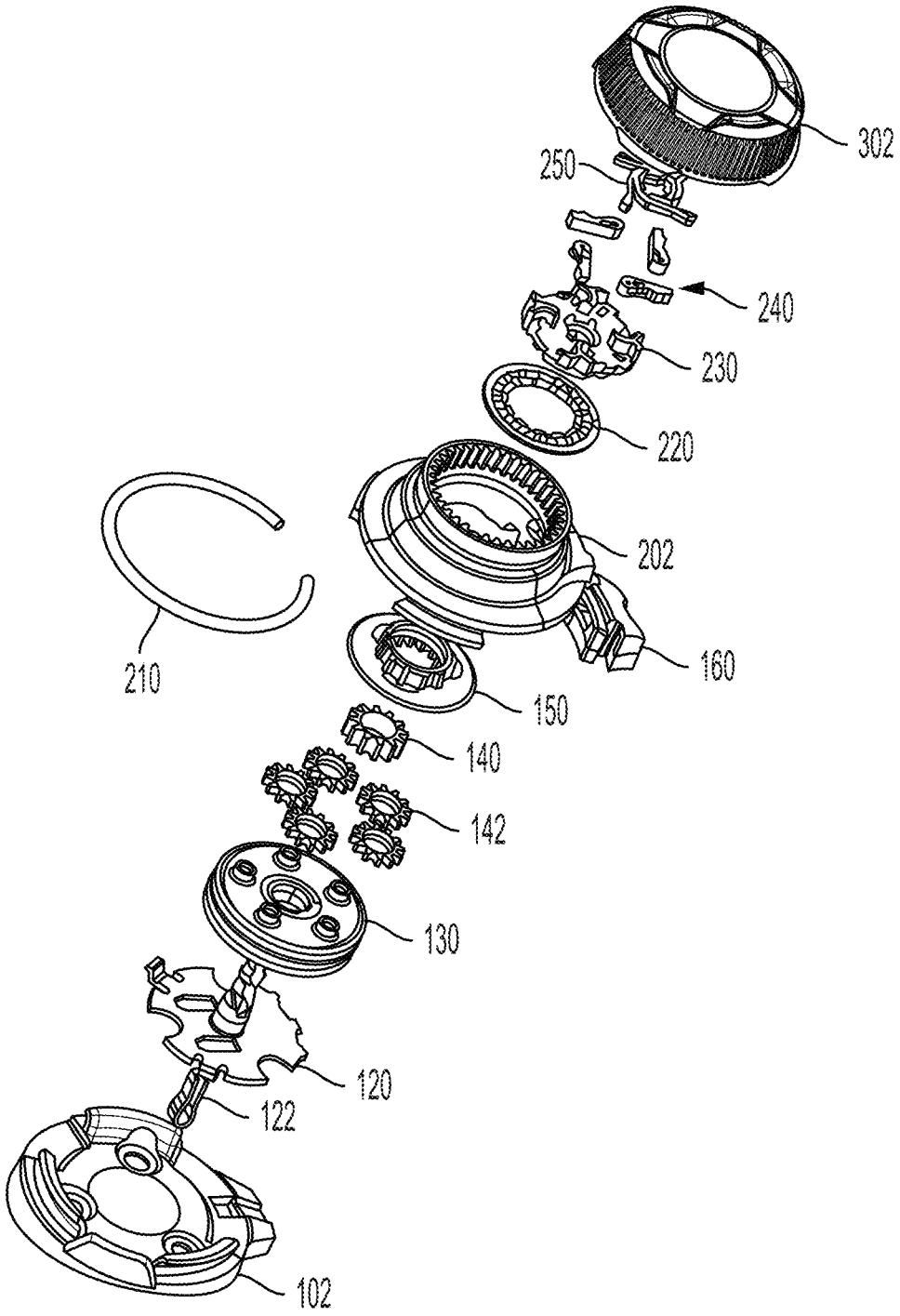
FIG. 2 illustrates an exploded perspective view of the reel based closure device of FIG. 1.

Referring to FIG. 1, illustrated is an assembled perspective view of a reel based closure device 100. FIG. 2 illustrates an exploded perspective view of the reel based closure device 100. FIGS. 3A-11B illustrate various views of the components of the reel based closure device 100. Reference will be made throughout this disclosure to the various Figures illustrating the reel based closure device 100.

FIG. 1 illustrates a base member or bayonet 102 that is designed to attach to a housing 202 of the reel based closure device 100. The base member 102 is designed to be attached to a ski boot shell (not shown) via mechanical fastening, adhesive bonding, molding, or using any other fastening technique. In a specific embodiment, the base member 102 may include one or more apertures 103 (see FIG. 8) that allow a bolt, rivet, screw, or other mechanical fastener to attach the base member 102 to a ski boot shell. The base member 102 is illustrated as including three apertures 103, although more or fewer apertures 103 may be employed.

The base member 102 is commonly a rigid material that is designed to withstand impact from external objects without breaking. In a specific embodiment, the base member 102 may be made of glass filled nylon, although various other rigid materials may alternatively be used. The base member 102 is designed to couple with the housing 202 in a manner that allows the housing 202 to be detached or removed from the base member 102. Various methods of attaching the housing 202 to the base member 102 may be employed, but in the illustrated embodiment, a spring member is used to fasten and couple the housing 202 to the base member 102. The spring member is designed to flex upon impact of an object with the housing 202 to allow the housing to detach from the base member 102 and thereby prevent breaking of the base member 102 and/or housing 202.

Figure 8:
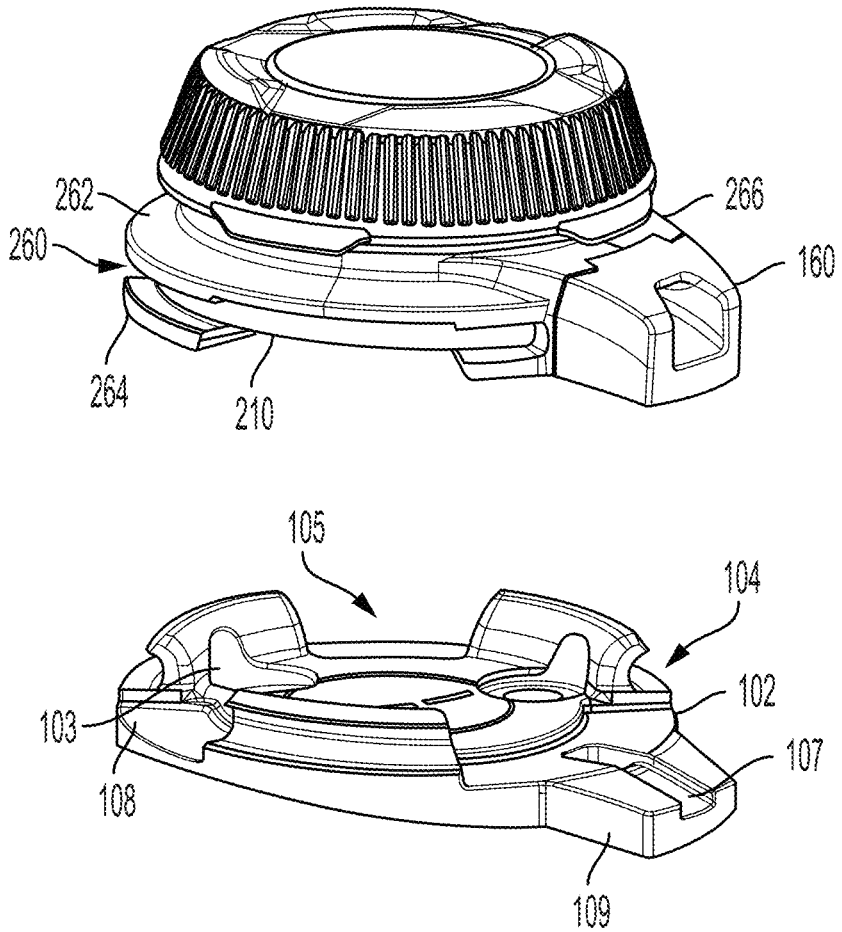
FIG. 8 illustrates a housing and base member of the reel based closure device of FIG. 1.

In some embodiments, the spring member may be a split ring or c-spring 210. The base member 102 includes one or more arcuate or curved axial extending members 104 (see FIGS. 9A-D) that define a recess or groove within which the c-spring 210 is positioned when the housing 202 is attached to the base member 102. The housing 202 similarly includes a groove 260 (see FIGS. 3B & 8) that houses the c-spring 210. The groove 260 of the housing 202 is shaped and sized so that the c-spring 210 fits securely within the groove 260. The groove 260 is defined by an upper annular lip or ring 262 and one or more radially protruding members 264. As illustrated in FIG. 8, the one or more radially protruding member 264 of the housing 202 are shaped and sized so that they are insertable within openings 105 between opposing pairs of axially extending members 104. The base member 102 includes recesses 108 on the circumferential edge that correspond to the shape and size of the radially protruding members 264. When the housing 202 is coupled with the base member 102, the radially protruding members 264 are positioned within the recesses 108, which enables the groove of the base member 102 to be aligned with the groove 260 of the housing 202. In the illustrated embodiment, the housing 202 includes three radially protruding members 264 and the base member includes three axially extending members 104, although more or fewer of such features may be employed as desired.

The radially protruding members 264 and/or annular lip 262 extend radially outward from the housing 202 so that when the housing 202 is coupled with the base member 102, a distal edge of the radially protruding members 264 and/or annular lip 262 is roughly aligned with a distal end of the base member 102. In this manner, the housing 202 and base member 102 may visually appear to seamlessly integrate with one another. To further secure the c-spring 210 to the housing, a lace port 266 of the housing 202 may include a pair of circumferentially extending apertures (not shown) that are positioned on opposing ends of the groove 260. The pair of circumferentially extending apertures are shaped and sized so that the opposing ends of the C-spring may be positioned within the apertures.

Figure 9A:
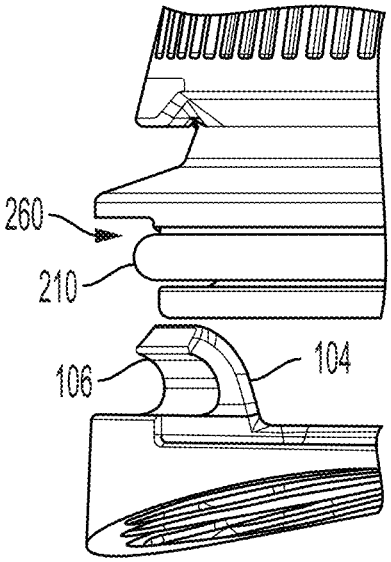
FIGS. 9A-9D illustrate attachment of the housing and base member of FIG. 8.
Figure 9B:
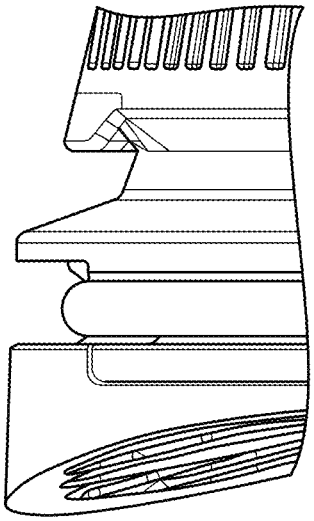

The c-spring 210 is designed to flex radially to enable the housing 202 to be attached and detached from the base member 102. For example, as illustrated in FIGS. 9A-B, to attach the housing 202 to the base member 102, the c-spring 210 is flexed so that the diameter of the c-spring is widened and is able to be fit over the axially extending members 104 and within the groove of the base member 102. Widening of the c-spring's diameter likewise enables the c-spring 210 to be fit within the groove 260 of the housing 202.

Figure 9C:
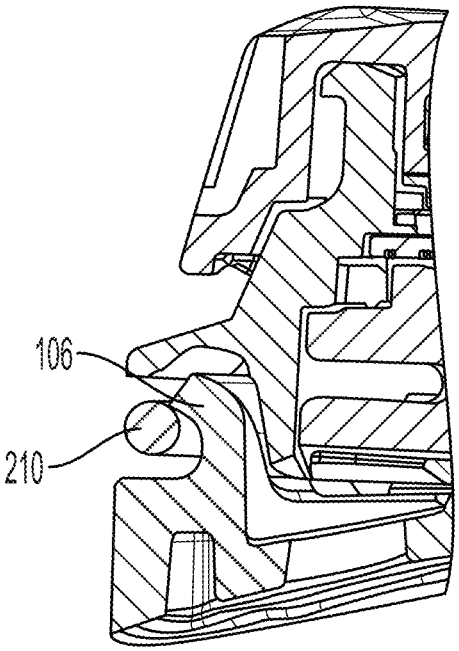
Figure 9D:
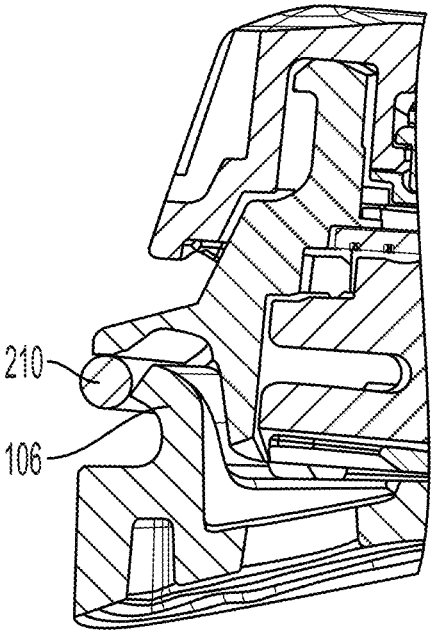

In order to allow the housing 202 to be detached from the base member 102, the axial extending members 104 are designed so that the c-spring 210 may deflect out of the groove. Specifically, the axial extending members 104 are curved near a top end 106 so that the diameter of the top end 106 of the axial extending members 104 is greater than a diameter of the axial extending members' groove. The greater diameter top end 106 of the axially extending member 104 helps secure the c-spring 210 within the groove while the curved or arcuate design enables the c-spring 210 to be easily flexed out of the groove. When an upward force is exerted on the housing 202, such as upon the housing 202 striking an object or upon application of a housing removal tool, the c-spring 210 is forced upward within the base member's groove. As illustrated in FIGS. 9C-D, the curved inner surface of the axially extending members 104 functions as a ramp and causes the c-spring 210 to flex radially outward as the c-spring 210 and housing 202 move axially upward relative to the base member 102. If the force is sufficiently strong, the c-spring 210 will flex sufficiently and will move out of the groove as shown in FIG. 9D, which detaches the housing 202 from the base member 102 and enables the housing 202 to be moved upward and out of contact with the base member 102. The force that is required to release or detach the housing 202 from the base member 102 may be varied by altering the angel of the inner surface of the axially extending members 104 and/or the stiffness of the c-spring.

To detach the housing 202 from the base member 102, the base member is designed to function with a housing removal tool. Specifically, the housing includes a support 109 for the lace exit component 160. The support 109 is shaped and sized in accordance with the lace exit component 160 in order to reinforce the lace exit component 160. A radially extending groove 107 is formed in the support 109, which enables a housing removal tool (not shown), such as a small flat head screw driver, to be inserted along the groove 107 and under the housing 202. With the housing removal tool positioned within the groove 107 and under the housing 202, the housing removal tool may apply an upward force on the housing 202 to detach the housing 202 from the base member 102.

Figure 10A:
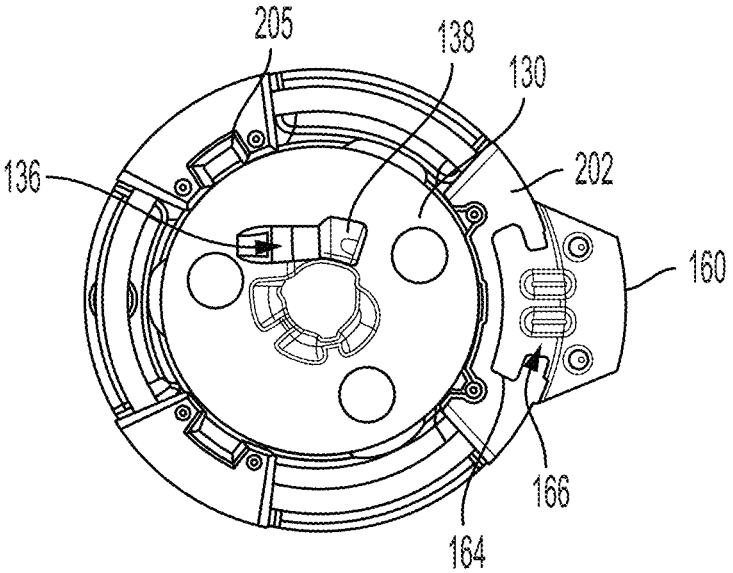
FIGS. 10A-10B illustrate the base member and a coupling component of the reel based closure device of FIG. 1.
Figure 10B:
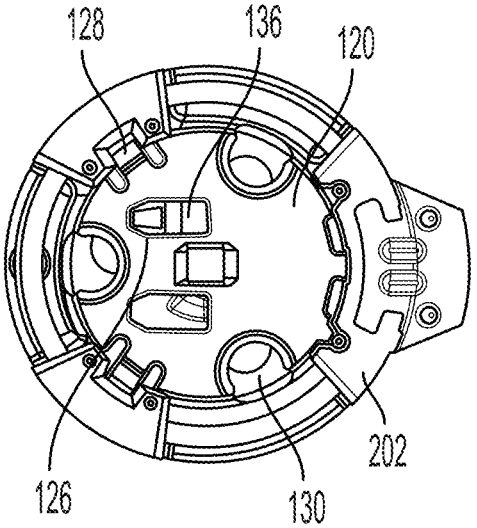

As illustrated in FIG. 2, a coupling component or member 120 is positionable between the base member 102 and the housing 202. The coupling component 120 is designed to attach to a bottom end of the housing 202 and is shaped and sized so that a bottom end of the coupling component 120 is positionable within an interior region of the base member 102. As illustrated in FIGS. 10A-B, the shape and size of the coupling component 120 corresponds with the shape and size of the bottom end of the housing 202. Specifically, the bottom end of the coupling component 120 is roughly circular in shape and is sized so that the coupling component 120 is insertable within a circular opening of the bottom end of the housing 202. To attach the coupling component 120 to the housing 202, the coupling component 120 includes upward extending tabs 128 that snap into corresponding slots 205 that are forward on the bottom end of the housing 202. The upward extending tabs 128 includes a radially outward extending nub that snaps or clips into a recess within a corresponding slot 205, which fastens the coupling component 120 to the housing 202. The coupling component 120 is illustrated as including two tabs 128, although more or fewer tabs may be employed as desired. A front portion of the coupling component includes radially extending nubs that fit within corresponding features on the housing 202. The nubs aid in alignment and securement of the coupling component 120 about the housing 202. The bottom end of the coupling component also includes one or more apertures (not labeled) that correspond in size and orientation to the apertures 103 in the base member 102. The apertures in the coupling component 120 allow the coupling component to be fit over a mechanical fastener (e.g., a bolt) that is inserted within the apertures 103 of the base member 102, which reduces an overall height of the reel based closure device 100. The coupling component 120 also includes one or more lace apertures 126, which are alignable with lace ports 136 in a spool 130 to enable easy coupling of the tension member with the spool 130 as described herein.

A boss 125 extends axially upward from the bottom end of the coupling component 120. When the coupling component is attached to the housing 202, the boss 125 protrudes axially upward into the interior region of the housing 202. The boss 125 includes a pair of fingers that are separated by a gap. The boss 125, and more specifically the pair of fingers, function to enable a dial core 230 to be moved axially upward and downward relative to the housing 202. A reinforcement spring 122 is positioned in the gap between the pair of fingers and is used to strengthen and reinforce the pair of fingers. The reinforcement spring 122 aids in resiliently deflecting the pair of fingers as a dial core 230 is moved axially upward and downward about the boss 125. The reinforcement spring 122 may stiffen the pair of fingers and prevent the pair of fingers from plastically deforming due to extended use of the closure device 100. The reinforcement spring 122 includes an aperture that engages with a small projection on the inner surface of the pair of fingers. Engagement of the aperture and projection locks or retains the reinforcement spring 122 in position relative to the pair of fingers.

The spool 130 is positionable within the bottom end of the housing 202, typically by inserting the spool 130 within the housing's open bottom end. The spool 130 includes a central aperture 132 through which the boss 125 of the coupling component 120 is inserted. The spool 130 is configured to rotate around the boss 125 in both a clockwise and counterclockwise direction with minimal frictional engagement between the two components. A gear mechanism (140, 142), drive component 150, and dial core 230 are also typically configured to rotate around the boss 125 in a clockwise and counterclockwise direction. The spool 130 includes a channel 133 within which the tension member (not shown) is wound as the spool 130 is rotated in a tightening direction (e.g., clockwise). The tension member is similarly unwound from about the central channel 133 as the spool 130 is rotated in a loosening direction (e.g., counterclockwise). The central channel 133 has a width that is slightly larger than the width of the tension member, which ensures that the tension member is wound about the central channel 133 as a "single stack", meaning that the wound tension member forms a single layer within the channel 133. The single stack winding of the tension member constrains vertical forces that the tension member might develop if it was coiled onto the spool in an uncontrolled manner and protects the tension member from damaging itself during the winding process. Given the substantial tension forces that the closure device 100 is capable of generating, winding the tension member about the spool 130 in an uncontrolled manner may cause excessive kinking and/or damage of the tension member.

As briefly mentioned above, the dial core 230 is axially moveable with respect to the housing 202. Movement of the dial core 230 relative to the housing 202 enables the tension member to be fully loosened, which means that the spool 130 is able to rotate in the loosening direction in a relatively unrestrained manner. The "fully loosening" feature is an optional feature that may be omitted in some embodiments of the closure device 100. To enable full loosening of the tension member, the closure device 100 is designed to move or transition between an engaged state or position in which the dial core 230 is operationally coupled with the spool 130 and a disengaged state or position in which the dial core 230 is operationally decoupled from the spool 130. The transition between the two states is achieved via axial movement of the dial core 230 relative to the housing 202. Axial movement of the dial core 230 relative to the housing 202 is commonly achieved via pulling axially upward on the knob 302. However, in other embodiments, the dial core 230 may be moved axially upward via a counter rotation of the knob 302 or via operation of a button (not shown), lever mechanism (not shown), clamp (not shown), and the like. In such embodiments, to move the dial core 230 axially upward, the knob 302 and dial core 230 may include cammed, ramped, or sloped surfaces, or another mechanism, that moves the dial core 230 axially upward as the knob 302 is rotated in the loosening direction or as the button, lever mechanism, etc. are operated.

Figure 4A:
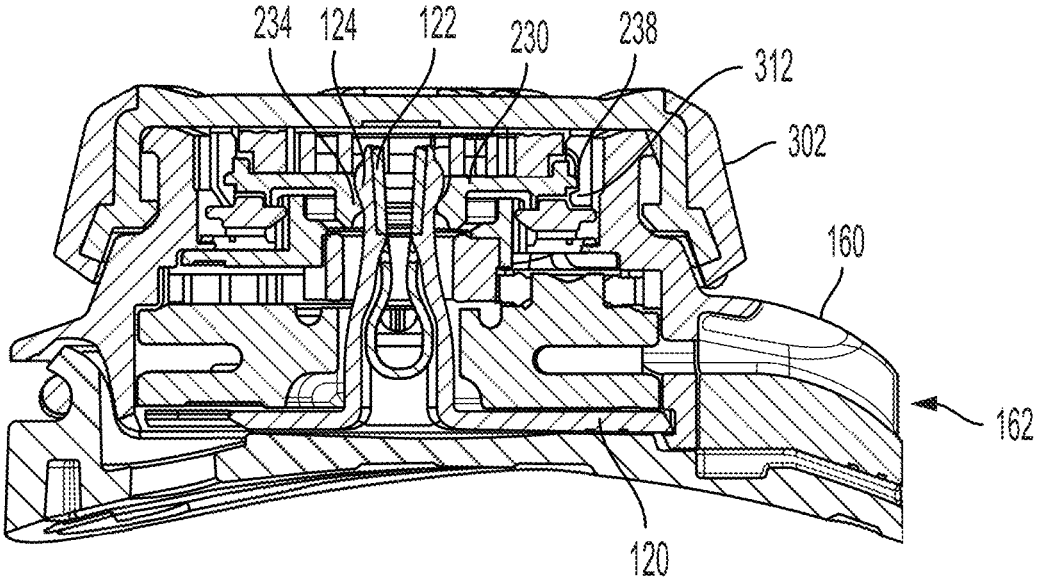
FIGS. 4A-4B illustrate cross-sectional assembled views of the reel based closure device of FIG. 1.
Figure 4B:
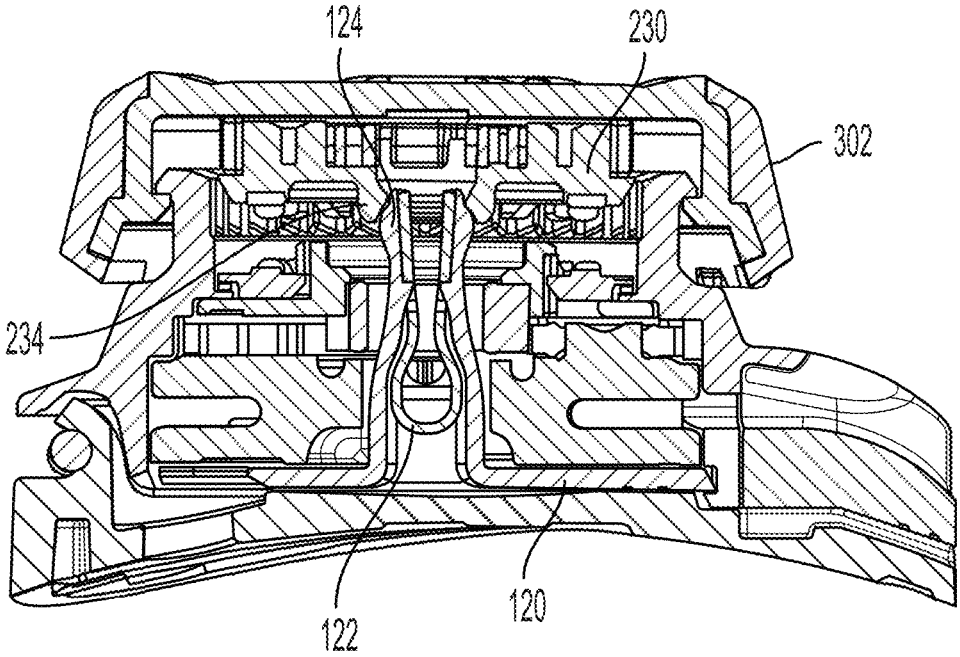

As illustrated in FIGS. 4A-B, the boss 125 is designed to cooperate with the dial core 230 to support and maintain the dial core 230 in either the engaged position or the disengaged position. Specifically, the top end of the boss 125 supports and maintains the dial core 230 and/or knob 302 in the engaged and disengaged positions via an annular projection or member 124. In one embodiment, the engaged position is illustrated in FIG. 4A while the disengaged position is illustrated in FIG. 4B. In the engaged position, the dial core 230 is engaged with the clutch plate 220, which enables forces to be transferred between these two components as described herein. In the disengaged position, the dial core 230 is disengaged from the clutch plate 220, which allows the spool 130 to "free wheel" or spin freely in the loosening direction within the housing 202. Similarly, in the disengaged position, one or more pawls 240 may be disengaged from teeth 204 that are formed on, or otherwise coupled with, the housing 202. In other embodiments, the one or more pawls 240 may remained engaged with the teeth 204 in the disengaged position.

The annular projection 124 has a diameter that is greater than a diameter of a central opening 234 of the dial core 230, which causes the annular projection 124 to interfere with and impede upward and downward movement of the dial core 230 about the top end of the boss 125. While the annular projection 124 impedes axial movement of the dial core 230, the annular projection 124 does not prevent axial movement of the dial core 230 due to the ability of the boss's fingers to displace or flex radially inward. As the dial core 230 is moved axially about the annular projection 124, the pair of fingers flex inward toward one another, which allows the central opening 234 of the dial core 230 to be is moved axially upward or downward about and over the annular projection 124. After the dial core 230 is moved axially upward or downward about the annular projection 124, the pair of fingers resiliently flex outward to resume an undeflected configuration. In operation, the central opening 234 of the dial core 230 is positioned above or below the annular projection 124, which supports and maintains the dial core 230 and/or knob 302 in either the engaged or disengaged position. The reinforcement spring 122 increases the stiffness of the boss 125 and reduces fatigue on the boss 125 due to repeated movement of the dial core 230 about the annular projection 124.

Figure 4C:
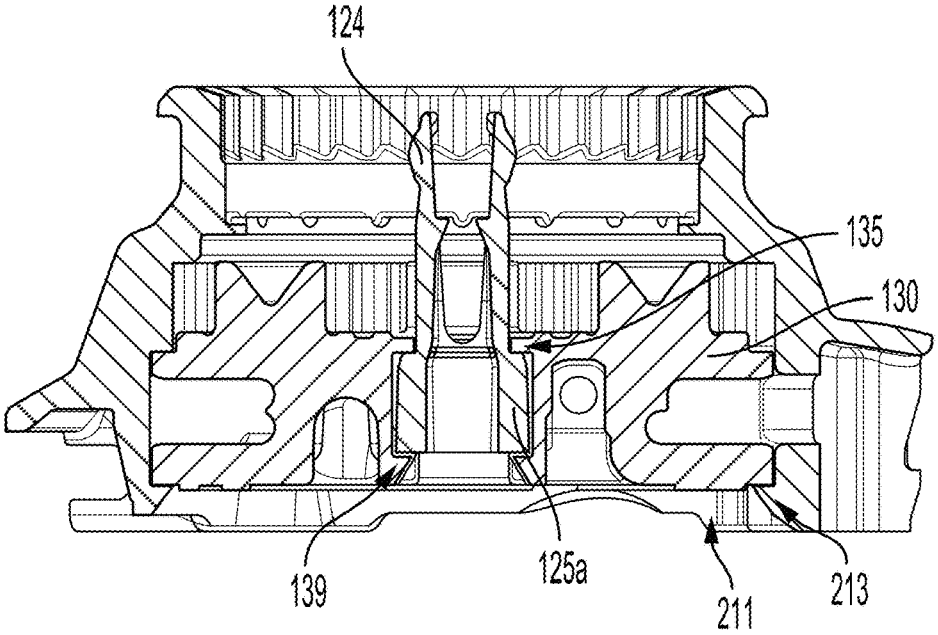
FIGS. 4C-D illustrate a cross-sectional view of the reel based closure device of FIG. 1 that includes an alternative central boss.
Figure 4D:
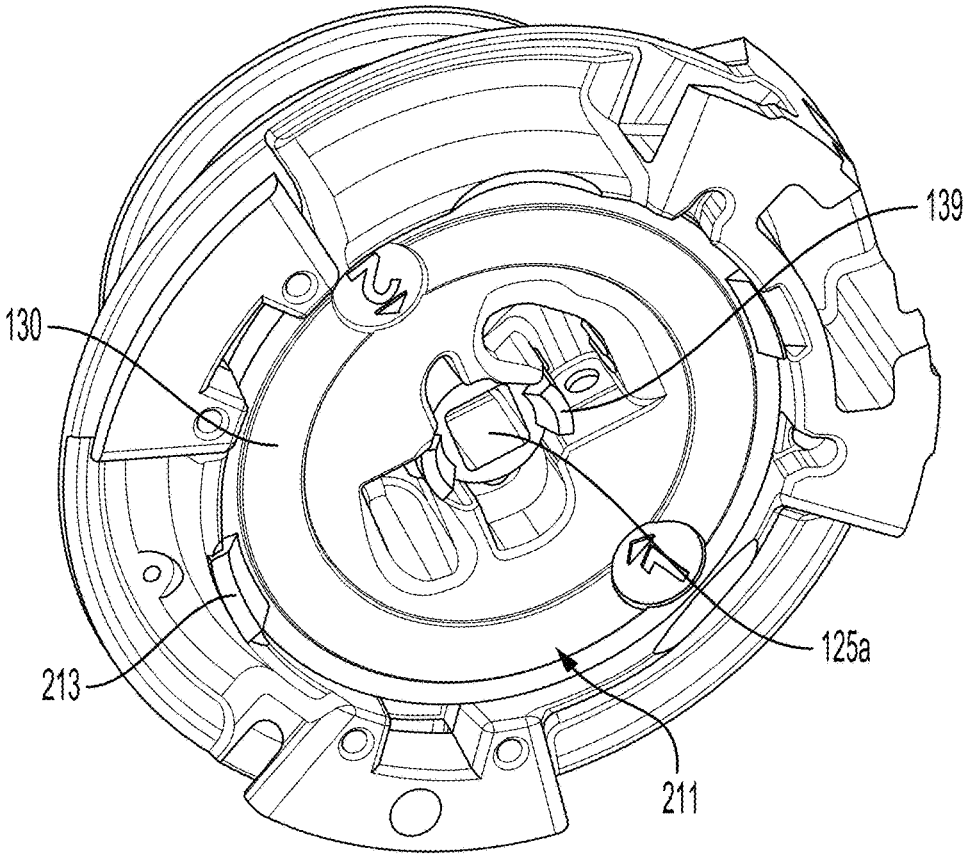
Figure 4E:
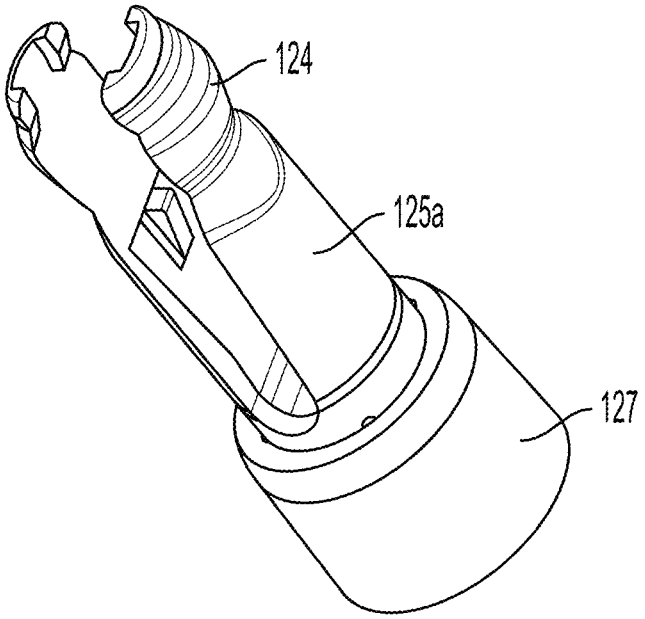
FIG. 4E illustrates an embodiment of a perspective view of the alternative central boss of FIGS. 4C-D.

FIGS. 4C-E illustrate a central boss 125*a* (hereinafter boss 125*a*) that may be used as an alternative to the coupling component 120. The boss 125*a* may have a configuration similar to the coupling component's boss 125 in that the boss 125*a* may protrude axially upward into the interior region of the housing 202 and include two or more fingers that are separated by a gap. A reinforcement spring 122 may be positioned in the gap between the two or more fingers to strengthen and reinforce the fingers as described herein. The boss 125*a* may also include an annular projection 124 that is configured to support and maintain the dial core 230 and/or knob 302 in the engaged or disengaged position. Unlike the boss 125, however, the boss 125*a* is a separate component and is not attached or permanently affixed to the coupling component 120. Rather, the boss 125*a* is designed to couple directly with the reel based closure device 100, such as coupling with the housing 202 or with the spool 130 as illustrated in FIGS. 4C-D. FIG. 4E illustrates an embodiment of the boss 125*a* as a separate component from the coupling component 120.

In FIG. 4E, the boss 125*a* includes a cylindrical base 127 that is shaped and sized to be positioned within the spool 130. Specifically, the boss 125*a* is insertable through the central aperture 132 of the spool 130 and is couplable or attachable to the spool 130. Since the boss 125*a* couples directly with the spool 130, the bottom end of the coupling component 120 may be eliminated. The elimination of the bottom end of the coupling component 120 may form or define a recess 211 as illustrated in FIGS. 4C-D. In some instances, an automatic winding mechanism, such as a spiral spring, may be positioned within the recess 211 of the housing 202 to automatically wind the tension member about the spool 130. Additional details of an automatic winding mechanism are provided in U.S. Pat. No. 7,992,261, entitled "Reel Based Closure System," the entire disclosure of which is incorporated by reference herein.

In other embodiments, the recess 211 may be omitted to reduce an overall height of the housing 202 and reel based closure device 100. As illustrated in FIG. 4D, the direct coupling of the boss 125*a* with the spool 130 also allows the bottom end of the spool 130 to be easily accessed for attachment of the tension member with the spool 130 since the coupling component 120 is not employed. Specifically, the spool's lace port 136 may be more easily accessed without require the lace apertures 126 illustrated in FIG. 10B. The boss 125*a* may also reduce the material that is used in the reel based closure device 100, which may render the device more environmentally friendly.

To couple the boss 125*a* with the spool 130, the boss 125*a* may be positioned below a bottom end of the spool 130 and coaxially aligned with the spool's central aperture 132. The boss 125*a* may then be inserted axially through the spool's central aperture 132 until the boss 125*a* is moved past a one way snap member or mechanism 139 (hereinafter snap member 139) that is formed on, or coupled with, the spool 130. The snap member 139 is designed to allow insertion of the boss 125*a* within the central aperture 132 of the spool 130 and to prevent removal or retraction of the boss 125*a* from the spool 130, thereby locking the boss 125*a* in position within the spool 130. As illustrated in FIGS. 4C-D, the snap member 139 may be formed or defined by one or more tabs or projections that include a lip or hooked end. In the illustrated embodiment, the spool 130 includes two tabs or projections. The one or more tabs are designed to flex radially outward as the cylindrical base 127 is inserted within the spool's central aperture 132. The one or more tabs then flex radially back into position and an upper surface of the lip or hooked end rests against a flat surface on the bottom end of the boss 125*a*, which locks or secures the boss 125*a* within the spool's central aperture. In the coupled state, the spool 130 and boss 125*a* may function as a single or integrated component.

The spool 130 may also include a bushing 135 that limits axial upward movement of the boss 125*a* relative to the spool 130. Specifically, the boss 125*a* may engage or register against a lower surface of the bushing 135 to prevent further upward axial movement of the boss 125*a* through the spool's central aperture 132. The bushing 135 may be a lip or annular flange that is formed on an inner surface of the spool's central aperture 132, or may be a separate bushing component or ring that is attached to the inner surface of the spool's central aperture 132. The boss 125*a* may include a corresponding annular lip or edge that is shaped and sized to accommodate the bushing 135. In the illustrated embodiment, the upper end of the cylindrical base 127 includes a chamfer, which engages the bushing 135. In other embodiments, the bushing 135 and/or the annular lip of the boss 125*a* may be formed as a single continuous piece or member or may be formed of a plurality of disconnected pieces or segments. In the latter embodiment, the disconnected pieces or segments may define an annular bushing and/or lip. The snap member 139 may likewise be formed of a single continuous piece or member or of a plurality of disconnected pieces or segments. The base 127 of the boss 125*a* may have a length that corresponds to the distance between the snap member 139 and the bushing 135.

Although FIGS. 4C-D illustrate the bushing 135 being on the upper end of the spool 130 and the snap member 139 being on the lower end, in some instances, the position of these components may be reversed so that the bushing 135 is positioned near the lower end of the spool 130 and the snap member 139 is positioned near the upper end of the spool 130. In such instances, the boss 125*a* would be inserted through the spool's central aperture 132 from the top end of the spool 130 rather than from the bottom end. In addition, while FIGS. 4C-D illustrate the boss 125*a* coupling directly with the spool 130, in other embodiments the boss 125*a* may be coupled or attached to other components of the reel based closure device 100. For example, the boss 125*a* may snap into the underside of the knob 302 and extend axially downward into the housing 202. Alternatively, the boss 125*a* may snap into a top surface of the base member 102 or a top surface of the spool 130 and extend axially upward into the housing 202. The boss 125*a* may likewise couple with the dial core 230, pawl disc 250, drive component 150, or sun gear 140 as desired. The attachment of the boss 125*a* to these components may be substantially similar to the coupling of the boss 125*a* and spool 130 described herein. In coupling the boss 125*a* with any of these various components, the respective component to which the boss 125*a* is coupled may include a snap member 139 and/or bushing 135 as described herein to facilitate in the coupling of the two components.

With the elimination of the coupling component 120, the spool 130 may be designed to couple directly with the housing 202. For example, the spool 130 may be axially inserted through the bottom end of the housing 202 and may be attached via one or more one way snap members or mechanisms 213 (hereinafter snap member 213). The snap member 213 may be formed on or coupled with the housing 202 and designed to allow the spool 130 to be inserted within the housing 202 while preventing removal or retraction of the spool 130. As illustrated in FIG. 4D, the snap member 213 of the housing 202 may be formed or defined by one or more tabs or projections that include a lip or hooked end. In the illustrated embodiment, the housing 202 includes two tabs or projections. The one or more tabs are designed to flex radially outward as the spool 130 is inserted within the housing 202. The one or more tabs then flex radially back into position and an upper surface of the lip or hooked end rests against the bottom end of the spool 130, which locks or secures the spool 130 within the housing 202. In this manner, the spool 130 may be locked in position within the housing's interior region. The housing's snap member 213 may be formed of a single continuous piece or member or of a plurality of disconnected pieces or segments as illustrated in FIG. 4D. The snap member 213 may also be formed on, or coupled, near the bottom of the housing 202 and engage a bottom end of the spool 130 or may be formed on, or coupled, upward from the bottom end to engage an upper flange of the spool 130. Positioning of the snap member 213 near the bottom end of the housing 202 is illustrated in FIGS. 4C-D, which may be preferred to minimize contact of the tension member with the snap member 213.

Figure 4F:
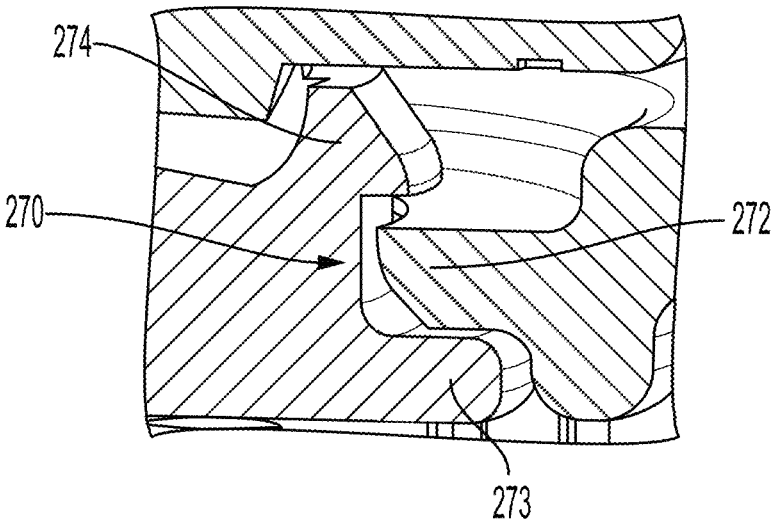
FIG. 4F illustrates an alternative embodiment of a snap member that may be used in the reel based closure device of FIG. 1.

FIG. 4F illustrates an alternative embodiment of a snap member or mechanism 272 (hereinafter snap member 272). The snap member 272 may be representative of the snap member 139 of the spool 130 and/or the snap member 213 of the housing 202. The snap member 272 is defined by an annular ring or protrusion, which may be formed of a single continuous material or disconnected segments. The snap member 272 is positionable within a recess 270 that is formed or defined on the opposite component, which may be the boss 125*a* and/or a lower flange of the spool 130. The recess 270 may be formed or defined by a lower surface 273 and an upper surface 274, which may be continuous annular members or disconnected segments. The use of disconnected segments for either the lower surface 273 or upper surface 274 may facilitate in positioning the snap member 272 within the recess 270. The recess 270 may be shaped and sized to allow relative rotation of the components, which is required in instances where the snap member 272 is used in coupling the spool 130 and housing 202. In some instances, the position of the snap member 272 and recess 270 may be reversed so that the snap member 272 protrudes radially outward and into the recess 270. In such instances, the snap member 213 of the housing 202 and/or the snap member 139 of the spool 130 would be a recess as illustrated in FIG. 4C. Other means of coupling components together may be employed, such as an O-ring and lip, opposite flange arrangement, mating tabs and apertures, and the like.

The knob 302 is coupled to the housing 202 by axially aligning the knob 302 and the housing 202 and by snapping the knob 302 atop an annular flange or rib 209 of the housing 202. Specifically, an inner wall or surface of the knob 302 includes one or more projections 304, or a radial lip, that snaps over the annular rib 209 of the housing 202 as the knob 302 is pressed and moved axially downward relative to the housing. The projections 304 of the knob 302 define an inner diameter that is smaller than an outer diameter of the annular rib 209. As such, in coupling the knob 302 with the housing 202, the inner wall of the knob 302 must flex outward to some degree and/or the housing 202 must flex inward to some degree to allow the knob 302 to be moved axially downward about and snap over the housing 202. After the knob 302 is moved axially downward, the projections 304 are positioned axially below the annular rib 209 of the housing 202. Due to the interference between the projections 304 and the annular rib 209, uncoupling of the knob 302 from the housing 202 via axially upward movement of the knob 302 is prevented or significantly impeded. Uncoupling of the knob 302 from the housing 202 may further be impeded by designing the annular rib 209 and/or projections 304 so that they do not naturally deflect outward as the knob 302 is forced upward relative to the housing 202. Additional details of the coupling of the dial core 230, knob 302, and housing 202 are provided in U.S. patent application Ser. No. 14/991,788, filed Jan. 8, 2016, entitled "Integrated Closure Device Components and Methods," the entire disclosure of which is incorporated by reference herein.

The housing 202 includes an annular ring or lip 206 that is disposed on an inner wall. The annular ring 206 functions as a partition and divides the housing 202 into an upper half and a lower half. The annular ring 206 is configured so that some of the components that are positioned in the lower half of the housing 202 contact and engage a bottom surface of the annular ring 206 and so that some of the components positioned in the upper half contact and engage an upper surface of the annular ring 206. The components that are positioned in the lower half of the housing 202 include the coupling component 120, spool 130, gear mechanism (140, 142), and drive component 150. The components that are positioned in the upper half of the housing 202 include a clutch plate 220, dial core 230, one or more pawls 240, and pawl disc 250. The annular ring 206 blocks or impedes these components from moving into the other half of the housing 202.

The gear mechanism (140, 142) is operably coupled with the spool 130. The gear mechanism (140, 142) increases the mechanical advantage of the closure device 100, which increases the torque output of the closure device 100 and increases the tension forces that the closure device 100 is capable of generating. The gear mechanism includes a sun gear 140, a plurality of planetary gears 142, and a ring gear 208. In some instances, such as in the claims, the planetary gears 142 may be referred to as an engagement member that engages with a plurality of teeth operably coupled with the housing. In such embodiments, the plurality of teeth that are operably coupled with the housing may be the ring gear 208. In other instances, the term "engagement member" may refer to a pawl beam that includes one or more teeth as described herein. In such instances, the plurality of teeth operably coupled with the housing may be housing teeth or other teeth that the pawl engages with. For ease in describing the embodiment, the term planetary gears 142 will be used herein.

Figure 3A:
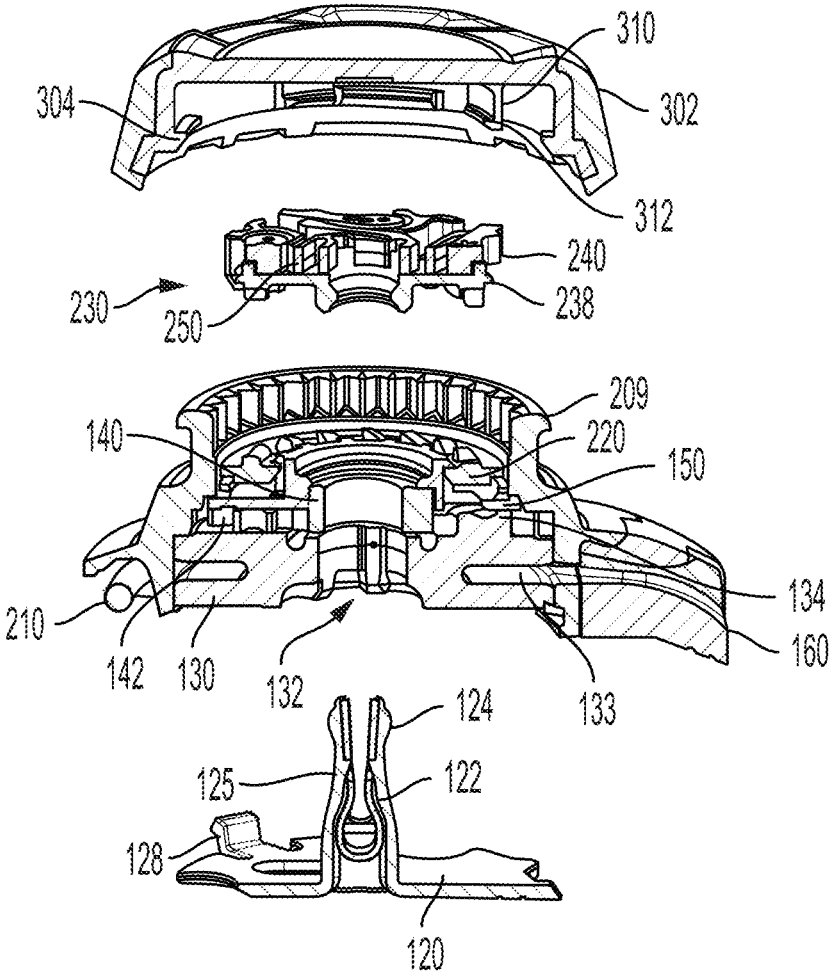
FIGS. 3A-3B illustrate cross-sectional exploded views of the reel based closure device of FIG. 1.

The ring gear 208 may include teeth that are formed on the inner wall of the housing 202 below the annular ring 206 or the ring gear 208 may be a separate component that is coupled with the lower half of the housing 202 (e.g., press fit, keyed, etc.). As illustrated in FIGS. 3A and 7, the sun gear 140 is coaxially aligned with and rests atop the spool 130 while each of the planetary gears 142 is rotatably positioned on a boss 134 that extends axially upward from an upper surface of the spool 130. The sun gear 140 is axially taller than the planetary gears 142 so that the upper portion of the sun gear 140 matingly engages with spline teeth 154 that are formed on a lower inner cylindrical wall of the drive component 150. The spline teeth 154 extend axially downward from an annular ring that is formed or positioned within the drive component 150.

As the drive component 150 is rotated in the tightening direction due to a rotation of the knob 302, the drive component 150 transfers rotational forces to the sun gear 140 due to mating engagement of the sun gear 140 and spline teeth 154, which causes the sun gear 140 to rotate in the tightening direction. Rotation of the sun gear 140 likewise causes the planetary gears 142 to rotate about the spool's bosses 134, which causes the planetary gears 142 to move in the tightening direction within the housing 202 due to engagement of the planetary gears 142 and the ring gear 208. Movement of the planetary gears 142 in the tightening direction causes the spool 130 to rotate in the tightening direction due to the engagement of the planetary gears 142 and the spool's bosses 134.

Figure 6A:
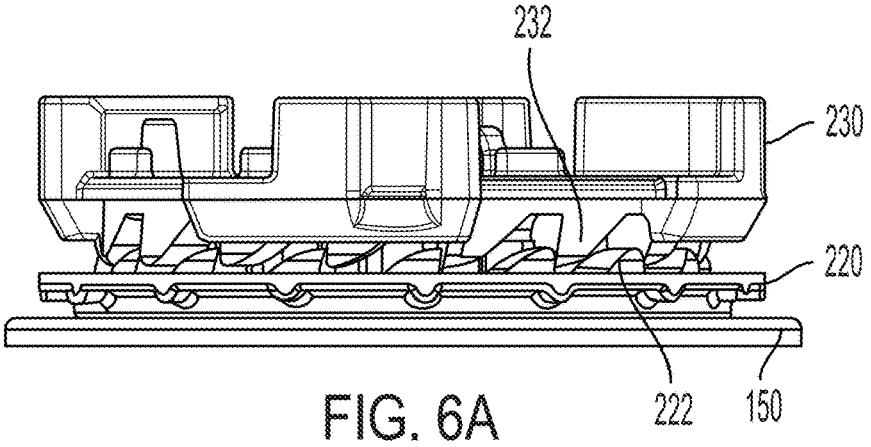
FIGS. 6A-6B illustrate several components of the reel based closure device of FIG. 1 and, more specifically, relative movement between the several components.
Figure 6B:
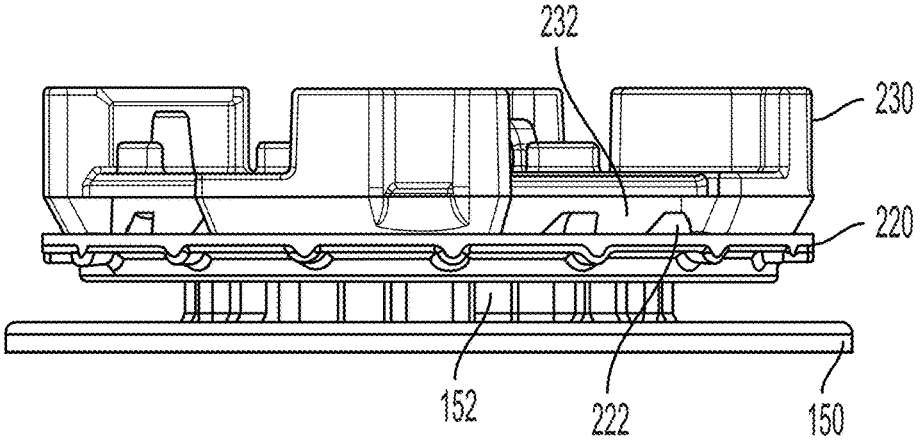
Figure 6C:
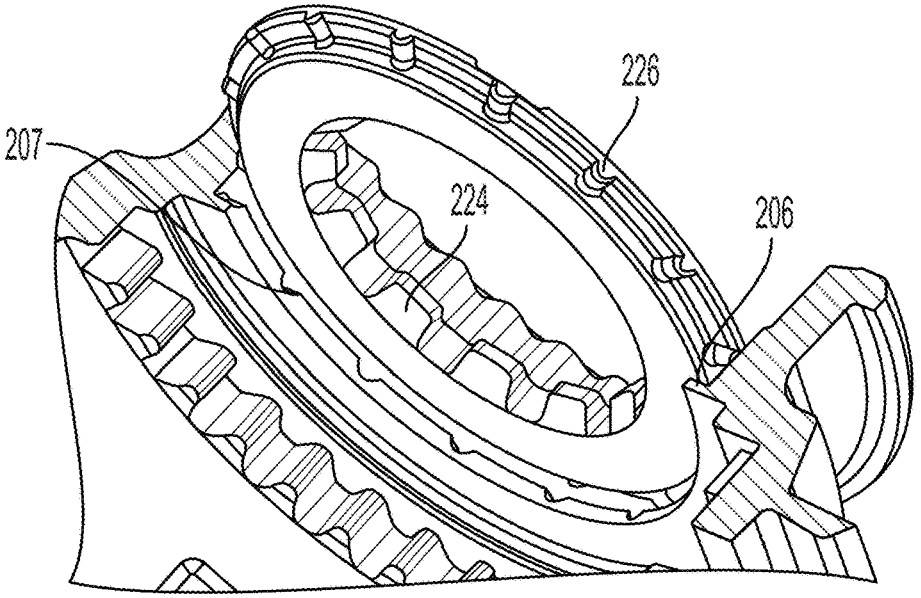
FIG. 6C illustrates a clutch plate positioned within a housing of the reel based closure device of FIG. 1.
Figure 6D:
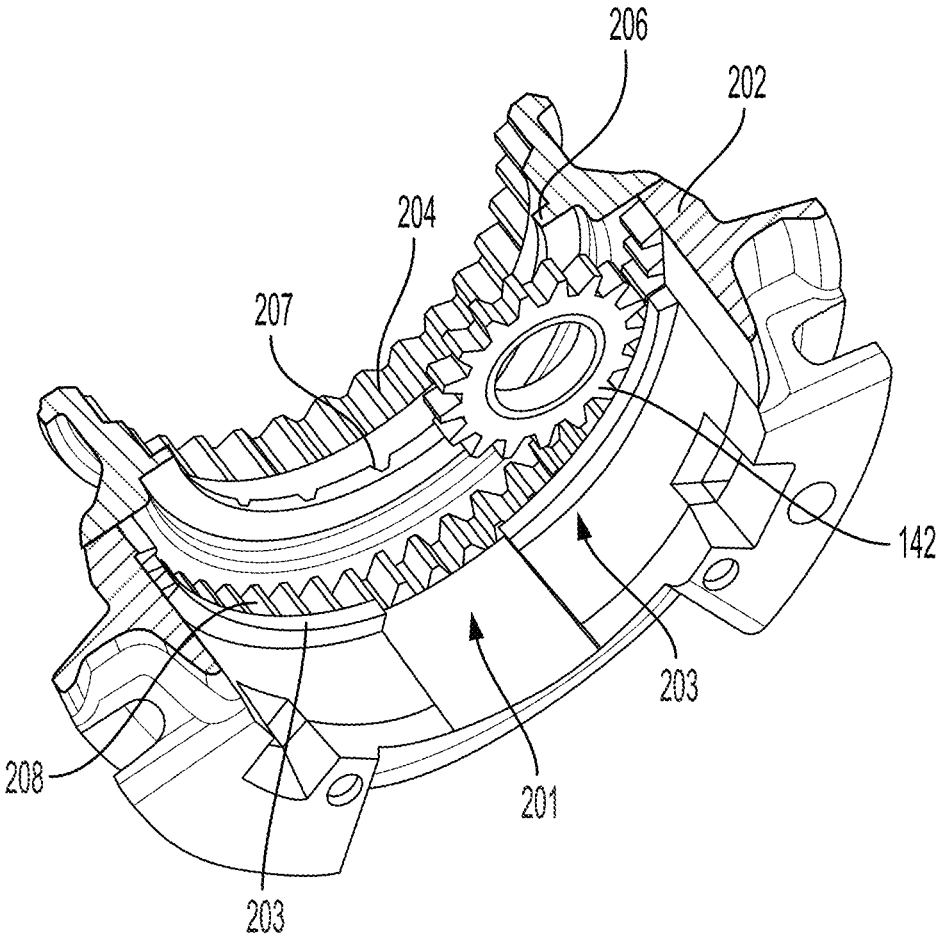
FIGS. 6D-H illustrate alternative structures that increase engagement of the ring gear and planetary gears of the reel based closure device of FIG. 1.

As illustrated in FIG. 6D, in some instances a support ring 203 is positioned axially below teeth of the ring gear 208. The support ring 203 is positioned and designed to support the teeth of the ring gear 208. Specifically, the planetary gears 142 stress or load the ring gear teeth due to the high forces that are induced during tensioning of the tension member. The stresses are typically the greatest on the axially bottom end of the ring gear teeth, which in other embodiments are not supported. The unsupported bottom end of the ring gear teeth may experience a bending moment in addition to shear forces from the ring gear teeth, which may cause the bottom end of the ring gear teeth to break, shear, and/or deform. This problem may be amplified when the ring gear teeth are made of a plastic material and the planetary gears 142 are made of metal, which is a typical material combination for the housing 202 and gear mechanism.

The support ring 203 greatly increases the strength of the ring gear teeth by supporting the bottom end of the teeth, thereby eliminating or reducing the bending moment that is induced on the teeth by the planetary gears 142. The support ring 203 is typically connected to the bottom end of the teeth and is commonly molded into the inner wall of the housing 202 along with the teeth. In other embodiments, the support ring 203 may be a separate component that is attached to the housing 202 and ring gear teeth.

Figure 6E:
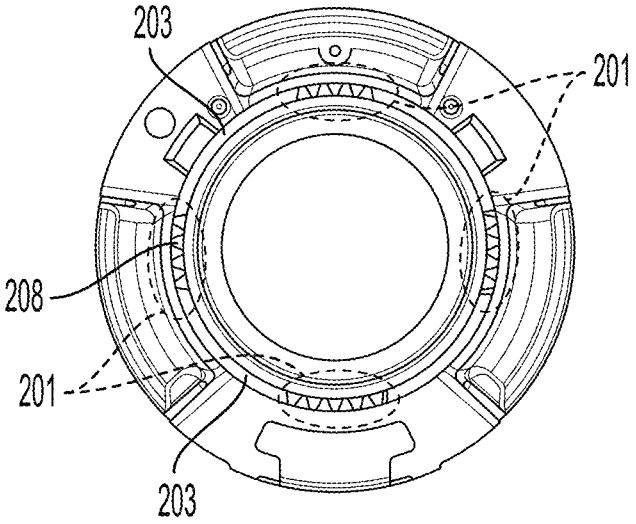

In some embodiments, the support ring 203 may be constructed of a plurality of disconnected ring segments. For example, as illustrated in FIG. 6E, the support ring 203 is constructed of four ring segments that are circumferentially separated by a gap 201. In other embodiments, more or fewer disconnected ring segments may be employed in forming the support ring 203, or the support ring 203 may be formed of a single connected and continuous segment that encircles the inner wall of the housing 202 below the teeth of the ring gear 208.

The use of the gaps 201 between discontinuous ring segments may aid in assembly the planetary gears 142 with the housing 202. Specifically, the gaps 201 may be strategically positioned and sized so that the planetary gears 142 are able to be axially inserted through the gaps 201 and into engagement with the teeth of the ring gear 208. In a specific embodiment, the position of each gap 201 is based on the position of a respective ring gear tooth when the respective tooth is preassembled with the spool 130. In the illustrated embodiment, each gap 201 is spaced approximately 90 degrees from an adjacent gap 201, although the spacing may be varied. The number of gaps 201 may also be equivalent to the number of planetary gears 142 employed in the gear mechanism. This arrangement of the gaps 201 allows the planetary gears 142 and spool 130 to be inserted within the housing 202 and each gear 142 to be engaged with the teeth of the ring gear 208. Once assembled, the planetary gears 142 can rotate axially above the support ring 203. In some instances, the support ring 203 may have a thickness that is roughly equivalent to the thickness of each ring gear tooth.

Figure 6F:
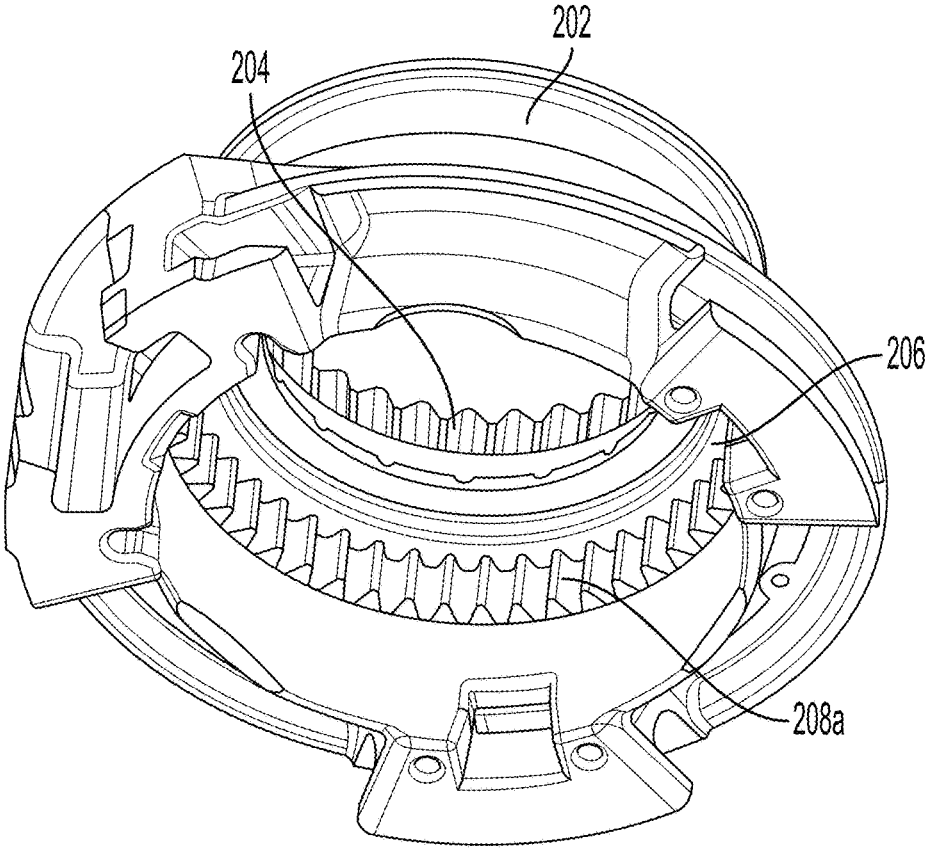
Figure 6G:
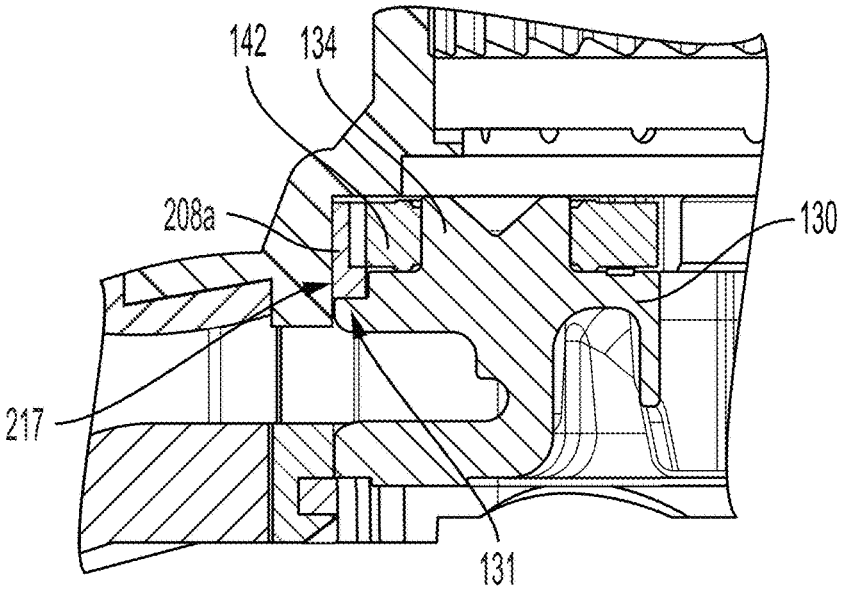
Figure 6H:
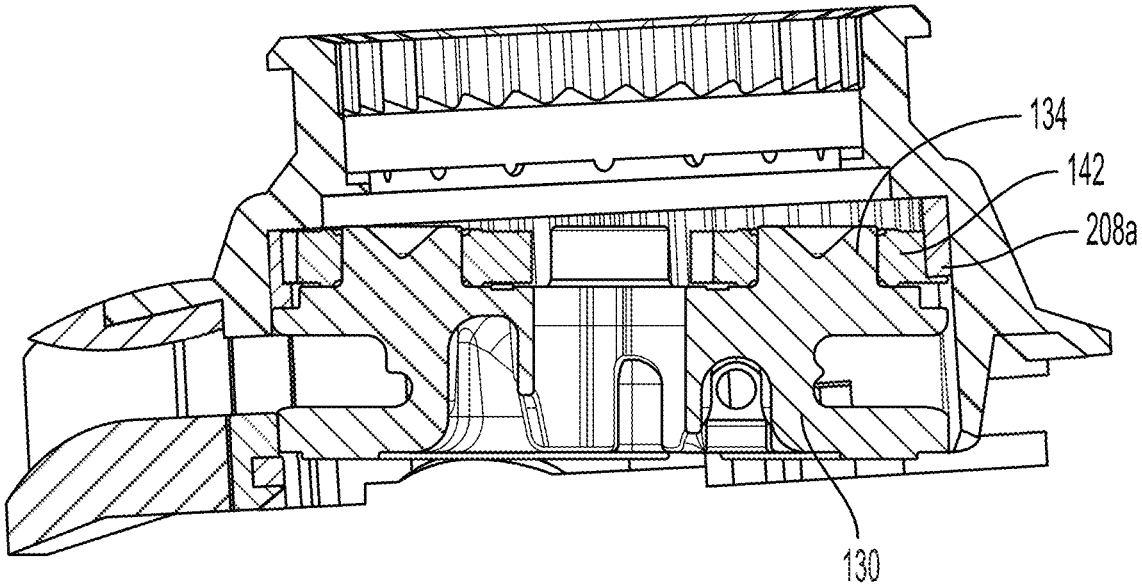

As illustrated in FIGS. 6F-H, in some instances the housing 202 may include extended ring gear teeth 208*a*. The extended ring gear teeth 208*a* are longer than the teeth of the planetary gears 142. The use of the extended ring gear teeth 208*a* may eliminate the need for the support ring 203, although in some instances the housing 202 may include both extended ring gear teeth 208*a* and a support ring 203. The extended ring gear teeth 208*a* reinforce the distal or bottom ends of the teeth 208*a*, which allows the spool 130 to tilt under load without the planetary gears 142 losing contact with the extended ring gear teeth 208*a*. Specifically, as illustrated in FIG. 6H, the spool 130 is able to tilt or pivot within the interior of the housing 202 while the teeth of the planetary gears 142 remain firmly engaged with the extended ring gear teeth 208*a*. FIG. 6H illustrates the spool 130 pivoting or tilting roughly 3 degrees within the interior of the housing 202. In some instances, the spool 130 may pivot or tilt more than 3 degrees while maintaining engagement of the planetary gears 142 and extended ring gear teeth 208*a* due to the extended length of the extended ring gear teeth 208*a*. The titling or pivoting of the spool 130, however, is typically limited due to the fit and configuration of the various components. The inclusion of the extended ring gear teeth 208*a* may minimize or eliminate the bending moment and shear forces described herein that may cause the bottom end of the ring gear teeth to break, shear, and/or deform. Stated differently, the extended ring gear teeth 208*a* may eliminate or reduce the bending moment that is induced on the teeth by the planetary gears 142 and thereby minimize or prevent problems associated therewith.

FIG. 6G is a cross section view that shows a planetary gear 142 positioned within the housing 202 and engaged with the extended ring gear teeth 208*a*. As illustrated in FIG. 6G, a bottom or distal end of the extended ring gear teeth 208*a* extends significantly below the bottom end of the planetary gear 142, which ensures that the planetary gear 142 remains engaged with the extended ring gear teeth 208*a* as the spool pivots or tilts within the housing 202 as illustrated in FIG. 6H. The longer length of the extended ring gear teeth 208*a* forms or defines a lower segment 217 that extends below the bottom end of the planetary gear 142. The planetary gear 142 may only engage this lower segment 217 as the spool 130 pivots or tilts within the housing 202, or otherwise moves axially to some degree within the housing 202. To accommodate the extended ring gear teeth 208*a*, an upper flange of the spool 130 may include an annular recess or lip 131 within or about which the lower segment 217 of the extended ring gear teeth 208*a* are positioned when not engaged with the planetary gears 142. The annular recess 131 may be sized and shaped—i.e., have a depth and width—that corresponds to the size and shape of the lower segment 217 to avoid or minimize any frictional engagement of the lower segment 217 and annular recess 131. In some instances, the upper flange of the spool 130 may have the annular recess or lip 131 even when the system does not include extended ring gear teeth 208*a*.

In some embodiments, the extended ring gear teeth 208*a* may be between 30% and 60% longer than any one or all of the teeth of the planetary gears 142. In other embodiments, the extended ring gear teeth 208*a* may be between 35% and 55% longer than any one or all of the teeth of the planetary gears 142 or may be between 40% and 50% longer than any one or all of the teeth of the planetary gears 142. In a specific embodiment, the extended ring gear teeth 208*a* may be between 4.50 mm and 5.00 mm while the planetary gear is between 3.10 mm and 3.60 mm. It should be noted that these values are examples only and do not limit the dimensions or ratios of the extended ring gear teeth 208*a* and planetary gears 142. In addition, as described herein, the extended ring gear teeth 208*a* may be formed on the housing 202 or may be a separate component that is attached to the housing 202.

Figure 7A:
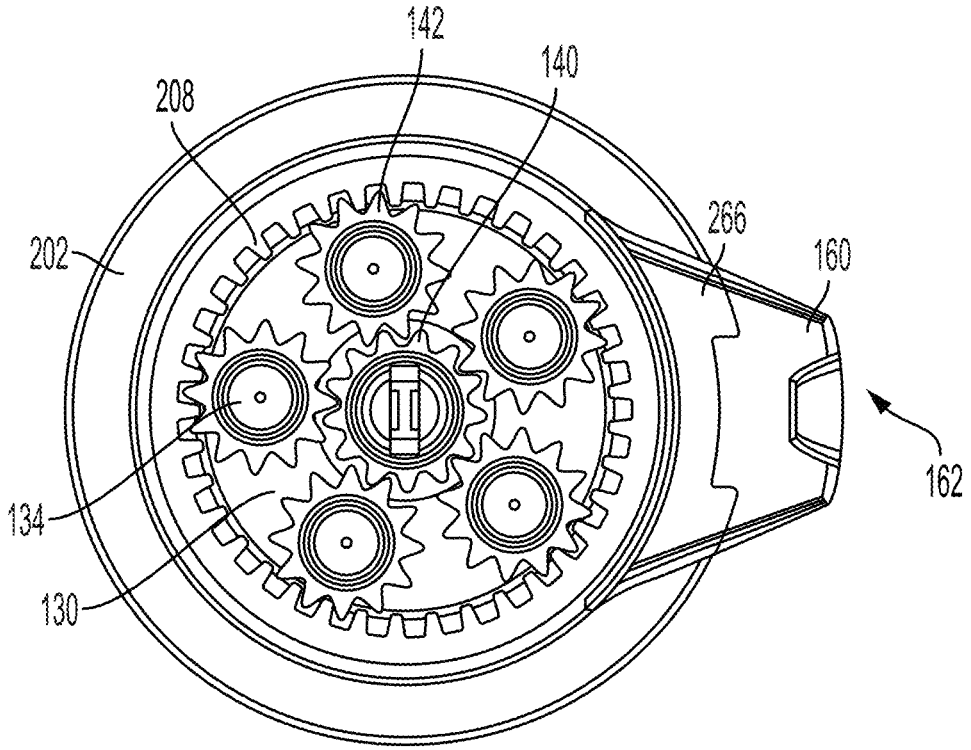
FIG. 7A illustrates a gear mechanism of the reel based closure device of FIG. 1.
Figure 7B:
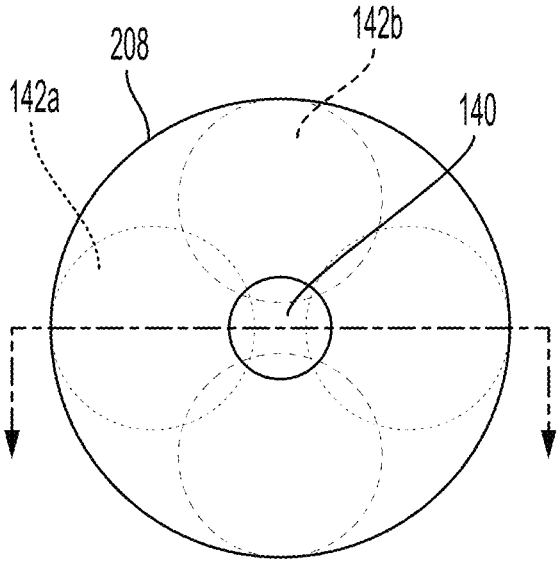
FIGS. 7B-F illustrates alternative gear mechanisms that may be used in the reel based closure device of FIG. 1.
Figure 7C:
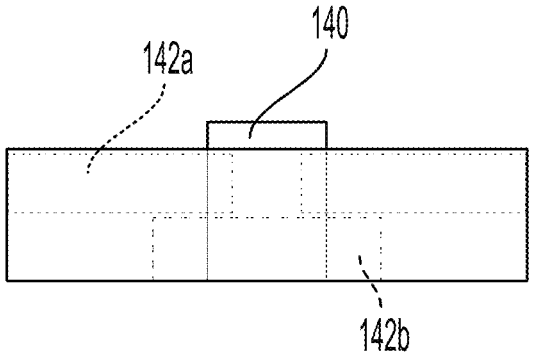

FIGS. 7B-F illustrate alternative embodiments of gearing that may be employed in the reel based closure device 100. One or more of the alternative gearing components may be employed when greater gear ratios are desired without substantially increasing the size of the reel based closure device 100. FIGS. 7B-C illustrate an embodiment in which the planetary gears 142 are arranged so that larger planetary gears 142 may be used to increase output power with less input torque. A problem that may be encountered with large planetary gears is that as the gear ratio of planetary gear and sun gear increases, the planetary gears 142 may begin to overlap or intersect. Overlapping or intersecting of the planetary gears 142 would not allow the gear system to operate due to interference of the gears. To eliminate this problem, the gear system of FIG. 7B includes an upper gear set 142*a* and a lower gear set 142*b*. As illustrated in the side view of FIG. 7C, the upper gear set 142*a* is positioned on a different plane (i.e., an upper plane) from the lower gear set 142*b*. Positioning the gear sets, 142*a* & 142*b*, on different planes ensures that the planetary gears due not overlap or intersect and engage one another. Thus, larger planetary gears may be used in the gear system. The sun gear 140 is reduced in size, which increases the gear ratio in the system and increases the output torque. The hub geometry on the spool 130 is arranged or designed to maintain the upper gear set 142*a* and lower gear set 142*b* in their respective planes.

Figure 7D:
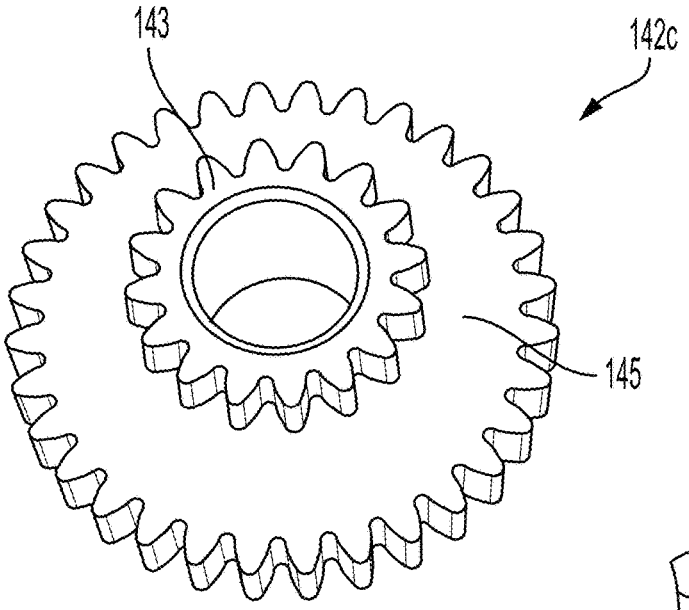
Figure 7E:
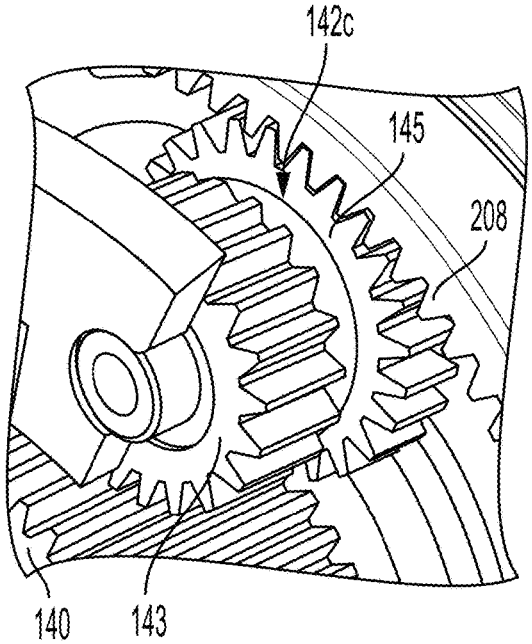

FIG. 7D illustrates a stacked planetary gear 142*c* that may be used as an alternative to the upper and lower gear sets, 142*a* & 142*b*, to achieve increased output torque without substantially increasing the size of the reel based closure device 100. The stacked planetary gear 142*c* includes an upper gear 143 and a lower gear 145 that is attached to the upper gear 143. The upper gear 143 has a smaller diameter than the lower gear 145 and also has a different tooth count than the lower gear 145. More specifically, the upper gear 143 has less teeth than the lower gear 145. As illustrated in FIG. 7E, the upper gear 143 is designed to engage the sun gear 140 while the lower gear 145 engages the ring gear 208. The stacked planetary gear 142*c* enables a more efficient gear train within a given diameter of the housing 202. The stacked planetary gear 142*c* also does not sacrifice tooth strength for increased output torque, which may occur as gear teeth are shrunken or reduced to increase torque. The stacked planetary gear 142*c* allows for a greater differential between the sun gear 140 and planetary gears 142, which equates to a greater gear ratio. This is achieved without shrinking or reducing the tooth size, thereby mitigating stress issues associated with large gear ratios.

In some embodiments, a similar stacked gear geometry could be used on the sun gear 140 to improve engagement between the sun gear 140 and drive component 150. Specifically, the sun gear 140 could include an upper gear and lower gear similar to the planetary gear 142 of FIG. 7D. In such instances, the upper gear would matingly engage with the spline teeth 154 of the drive component 150 while the lower gear would engage with the planetary gears 142, 142*a*, or 142*c*.

Figure 7F:
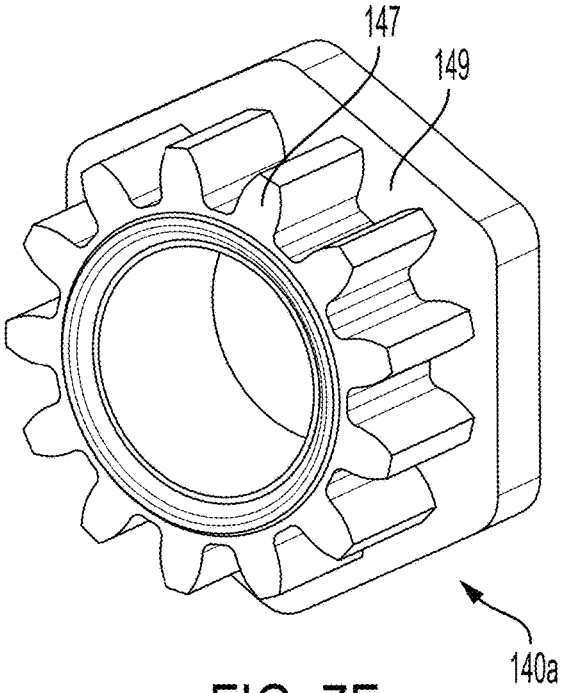

FIG. 7F illustrates an alternative sun gear 140*a* that may be used in place of the sun gear 140 described herein. The sun gear 140*a* includes a polygon shaped base 149 and a toothed gear 147 that extends therefrom. The sun gear 140*a* may be employed in instances where an increased coupling of the sun gear and drive component 150 is required. For example, in high load or high torque applications, the small teeth of the sun gear 140 and spline teeth 154 of the drive component 150 may be insufficient to handle a required load/torque. In such instances, the larger polygon base 149 may reduce stress between the sun gear and drive component 150 and thereby enhance the load/torque handling capabilities of the sun gear 140*a*. When the sun gear 140*a* is employed, the drive component 150 would include a correspondingly shaped aperture that receives the polygon shaped based 149. In the illustrated embodiment, the polygon shape of the base 149 is a hexagon, although other shapes such as a pentagon, octagon, and the like may be used.

In some embodiments, the gear mechanism (140, 142) may be omitted. In such embodiments, the drive component 150 may directly interface with the spool 130 in order to transfer rotational forces to the spool 130. It may be desirable to omit the gear mechanism when the end application of the closure device 100 does not require substantial tension forces and torque output. Removal of the gear mechanism may enable the closure device 100 to be axially smaller, which may be preferred in some embodiments. The drive component 150 may directly interface with the spool 130 via axially oriented teeth, spline teeth, and the like.

The drive component 150 functions to transfer forces from the components that are positioned above the annular ring 206 (i.e., the clutch plate 220, knob 302, etc.) to the components that are positioned below the annular ring 206 (i.e., the spool 130, gear mechanism, etc.). To enable transferring of forces, the drive component 150 is operationally coupled with the clutch plate 220. The drive component 150 includes an outward facing spline 152 that is positioned on an upper surface of the drive component 150. The spline 152 couples with corresponding teeth 224 on the clutch plate 220. Engagement of the spline 152 and teeth 224 allows torque to be transmitted through the clutch plate 220 and drive component 150 to the gear mechanism (140, 142) and spool 130.

In one embodiment, the drive component 150 and clutch plate 220 are assembled together via a snap fit coupling. Specifically, one or more radially outward extending tabs (not numbered) are positioned between a pair of teeth of the drive component's spline 152. The one or more radially outward extending tabs are positioned above a corresponding tooth 224 of the clutch plate 220 when the clutch plate 220 is coupled with the drive component 150. The clutch plate 220 is snap fit coupled with the drive component 150 by coaxially aligning the clutch plate 220 and drive component 150 and by pressing the clutch plate 220 axially downward and onto the drive component 150. The two components deflect to some degree as the clutch plate 220 is pressed axially downward onto the drive component 150 and as one or more of the clutch component's teeth 224 move past the corresponding outward extending tabs. Once assembled, the one or more radially outward extending tabs contact the corresponding teeth 224 as the clutch plate 220 is moved axially upward relative to the drive component 150, which prevents uncoupling of the two components.

Figure 3B:
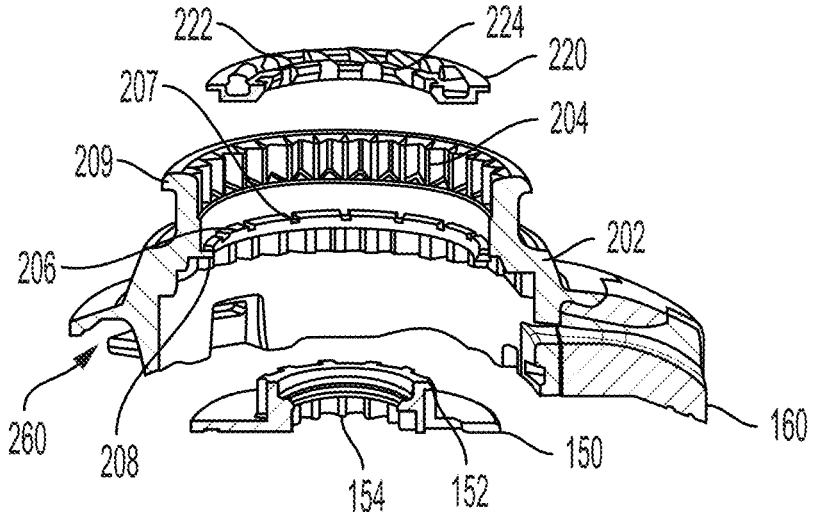

As illustrated in FIG. 3B, the drive component 150 is positioned below the annular ring 206 while the clutch plate 220 is positioned above the annular ring 206. When these two components are coupled together, the annular ring 206 is sandwiched between the two components, which essentially locks the housing 202, the clutch plate 220, and the drive component 150 together. The clutch plate 220 is designed to engage a top surface of the annular ring 206 in order to prevent a rotation of the spool 130 in the loosening direction once a tension in the tension member is decreased to a tension threshold or below the tension threshold. The tension threshold is commonly at or near a point in which minimal tension, or no tension, is present in the tension member. This point typically corresponds to a point in which the tension member has been fully unwound from about the spool 130. Preventing rotation of the spool 130 in the loosening direction once the tension member is at or near a zero tension threshold prevents back winding of the tension member about the spool 130, which prevents kinking or entangling of the tension member about the spool 130.

As illustrated in FIGS. 3B and 6C, the housing's annular ring 206 includes a plurality of depressions or teeth 207 (hereinafter depressions 207) that are arranged, and evenly spaced, circumferentially around the annular ring 206. The depressions 207 are configured to engage corresponding nubs or teeth 226 (hereinafter nubs 226) that are positioned circumferentially around, and evenly spaced, on an outer edge or ring of the clutch plate 220. When the nubs 226 engage the depressions 207 on the annular ring 206, the clutch plate 220 is prevented from rotating relative to the housing 202 and annular ring 206. Engagement of the nubs 226 and the depressions 207 locks the clutch plate 220 in position relative to the annular ring 206. The spool 130 is also prevented from rotating within the housing 202 due to the coupling of the drive component 150 with the spool 130 and the coupling of the clutch plate 220 with the drive component 150 as described herein.

Figure 5A:
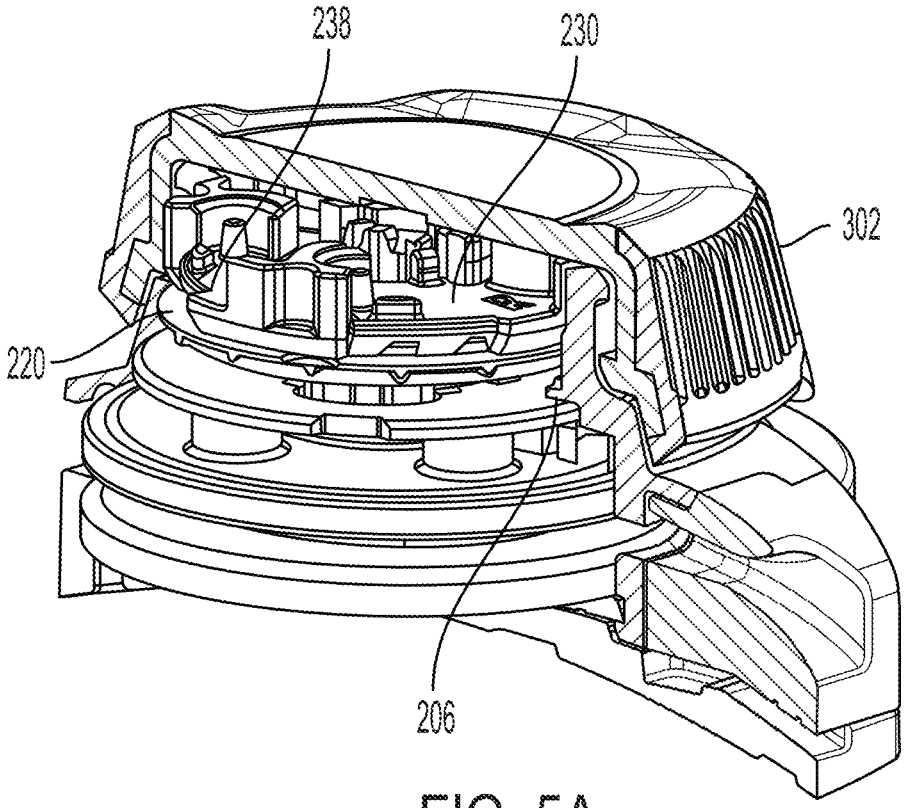
FIGS. 5A-5B illustrate cross-sectional assembled perspective views of the reel based closure device of FIG. 1.

To engage the annular ring 206, the clutch plate 220 moves axially downward within the interior of the housing 202. The clutch plate 220 is designed to move downward within the housing 202 only when the tension in the tension member reaches the tension threshold or decreases beyond the tension threshold. The nubs 226 and the depressions 207 are disengaged when the clutch plate 220 is in an axially raised position, which position is illustrated in FIGS. 4A, 5A, and 6B. As shown in the images, the bottom surface of the clutch plate 220 is positioned above the annular ring 206 and thus, the nubs 226 and the depressions 207 are disengaged, which allows the spool 130 to rotate in both the tightening and loosening directions. After the nubs 226 and the depressions 207 engage, further rotation of the spool 130 in the loosening and tightening directions is prevented.

As illustrated in FIGS. 5A and 6B, the clutch plate 220 is maintained in the axially raised position due to engagement of the clutch plate 220 and the dial core 230. Specifically, the clutch plate 220 includes upper teeth 222 that engage with axial teeth 232 of the dial core 230. The clutch plate's upper teeth 222 extend axially upward from an upper surface of the clutch plate 220 while the axial teeth 232 of the dial core 230 extend downward from a lower surface of the dial core 230. The clutch plate's upper teeth 222 and the dial core's axial teeth 232 may include a slight taper or sloped configuration that biases the clutch plate 220 axially upward when the teeth are engaged. Tension in the tension member facilitates in engagement of the clutch plate's upper teeth 222 and the dial core's axial teeth 232 by biasing the clutch plate 220 toward rotation in the loosening direction via the spool 130 and drive component 150. The clutch plate's upper teeth 222 and the dial core's axial teeth 232 remain engaged until the tension in the tension member reaches or exceeds the tension threshold, after which point the tension member no longer biases the clutch plate 220 toward rotation in the loosening direction. As the tension in the tension member is reduced to near the tension threshold, the engagement of the clutch plate's upper teeth 222 and the dial core's axial teeth 232 begins to reduce, which allows the clutch plate 220 to begin to slide axially downward relative to the dial core 230 as illustrated in FIG. 6A.

Figure 5B:
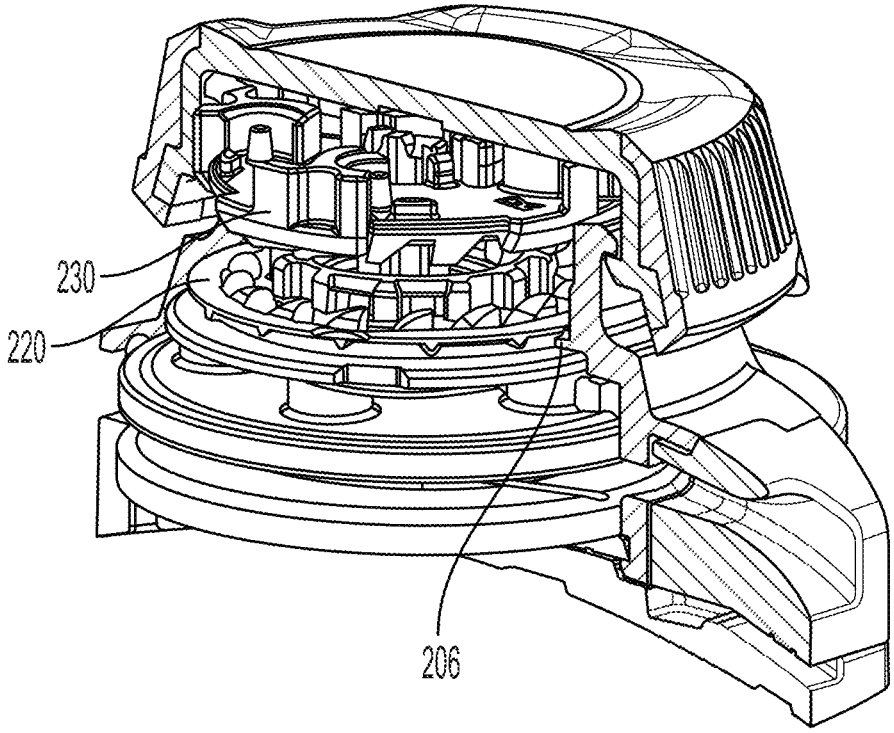

At some point near the tension threshold, the clutch plate 220 will slide downward and into engagement with the annular ring 206, which prevents further rotation of the clutch plate 220, drive component 150, and spool 130 as described herein. For simplicity in illustrating the various components, the annular ring 206 is omitted from FIG. 6A. However, it should be realized that the position of the clutch plate 220, drive component 150, and dial core 230 in FIG. 6A corresponds to a position in which the clutch plate 220 would be engaged with the annular ring 206. The clutch plate 220 is also able to move axially downward when the dial core 230 is moved axially upward as illustrated in FIGS. 4B and 5B. Axially upward movement of the dial core 230 forces the clutch plate's upper teeth 222 and the dial core's axial teeth 232 to disengage. The clutch plate 220 is prevented from moving upward with the dial core 230 due to engagement of the drive component's one or more radially outward extending tabs and corresponding teeth 224 of the clutch plate 220. Disengagement of the clutch plate 220 and the dial core 230 as illustrated in FIGS. 4B and 5B allows the spool 130 to "free wheel" or spin freely in the loosening direction within the housing 202 because the clutch plate 220 and dial core 230 are not rotationally locked or coupled together.

In some embodiments, the nubs 226 and depressions 207 may be designed so that they do not immediately engage when the clutch plate 220 moves axially downward and into contact with the annular ring 206. This configuration may allow the spool 130 to spin freely in the loosening direction when the dial core 230 is moved axially upward. For example, when the dial core 230 is moved axially upward as described herein, the clutch plate 220 is no longer engaged with the dial core 230 and thus, the clutch plate 220 is able to move axially downward into contact with the annular ring 206. In such instances, the clutch plate 220 may contact the annular ring 206 even when tension remains in the tension member. To enable the spool 130 to spin freely in the loosening direction when the clutch plate 220 contacts the annular ring 206, the nubs 226 and depressions 207 may not engage in the locking manner described above. Rather, the nubs 226 and depressions 207 may be designed so that the nubs 226 ramp or move out of the depressions 207 as the spool 130 rotates in the loosening direction, which prevents the spool 130 from being rotationally locked to the housing 202. More specifically, the nubs 226 and depressions 207 may have a rounded or angled shape, which allows the nubs 226 to ramp or move out of engagement with the depressions 207. In such instances, the nubs 226 and depressions 207 are still able to engage when the knob 302 is rotated in a loosening direction and the tension member is near the tension threshold. In such instances, the dial core 230 pushes or forces the clutch plate 220 downwards, which forces the nubs 226 and depressions 207 to remain locked or engaged together and thereby prevents the clutch plate 220 and spool 130 from rotating in the loosening direction.

To enable axial movement of the clutch plate 220 about the drive component 150, the drive component's spline 152 and the clutch plate's teeth 224 are configured to allow for such axial movement as illustrated in FIGS. 6A and 6B. Specifically, the drive component's spline teeth are axially elongated in comparison with the clutch plate's teeth 224, which allows the shorter clutch plate's teeth 224 to slide axially within channels or grooves formed between the spline teeth.

After engagement of the nubs 226 and the depressions 207, the closure device 100 is configured so that the knob 302 is rotatable in the loosening direction without affecting rotation of the spool 130. Specifically, as illustrated in FIG. 6A, a rear surface of the dial core's axial teeth 232 and a rear surface of the clutch plate's upper teeth 222 are oppositely sloped or ramped so that a rotation of the dial core in the loosening direction causes the rear surfaces to engage and causes the dial core 230 to skip over the clutch plate 220, which pushes or forces the clutch plate 220 downwards as previously described. As further illustrated in FIG. 6A, the dial core's axial teeth 232 and the clutch plate's upper teeth 222 slightly overlap when the dial core 230 is in the axially lowered position so that a rotation of the dial core 230 in the tightening direction (via the knob 302) causes the dial core 230 and clutch plate 220 to reengage, which pulls or biases the clutch plate 220 into the axially raised position illustrated in FIG. 6B and allows the spool 130 to be rotated in the tightening and loosening directions. The dial core 230 and clutch plate 220 reengage due to the clutch plate 220 resisting rotation in the tightening direction due to tension in the tension member and/or engagement of the clutch plate's nubs 226 with the annular ring's depressions 207.

In some embodiments, the clutch plate's nubs 226 and the annular ring's depressions 207 may be replaced by other frictional components, such as a rubber type gasket or material, abrasive materials, tacky materials, and the like. As illustrated in FIG. 6C, the clutch plate's nubs 226 may be axially recessed from a bottom surface of the clutch plate 220, which allows the clutch plate 220 to sit lower about the annular ring 206. For example, the nubs 226 may be formed or positioned on a circumferential ring or edge that is axially recessed from a bottom surface of the clutch plate 220. In some embodiments, the bottom surface of the clutch plate 220 may be roughly aligned with the bottom surface of the annular ring 206 and/or the bottom surface of the clutch plate 220 may contact the upper surface of the drive component 150 when the clutch plate's nubs 226 engage with the annular ring's depressions 207.

The dial core 230 is configured to couple with the knob 302, typically via a snap fit coupling. In some embodiments, the knob 302 includes axially extending tabs 310 that are configured to couple with corresponding edges or lips 238 of the dial core 230. The tabs 310 each include a radially inward lip 312 that is shaped and sized to fit under a corresponding edge 238 of the dial core 230 (see FIG. 4A). The tabs 310 are resilient, which enables the tabs to snap into engagement with the dial core's edges 238. The tabs 310 are also sufficiently strong so that axially upward forces imparted on the knob 302 (e.g., a user pulling the knob axially upward) are transferred to the dial core 230 and cause the dial core 230 to move axially upward with the knob 302. As such, the knob 302 and dial core 230 essentially move as a single component.

The tabs' inward lips 312 couple with the dial core's edges 238 in a manner that allows the knob 302 to rotate about the dial core 230 to some degree, which enables the knob 302 to be rotated in the loosening direction to incrementally loosen tension as described below. To enable the relative movement of the knob 302, the dial core's edges 238 are sized slightly larger than the tabs' inward lips 312. As illustrated in FIG. 5A, the dial core's edges 238 are formed by recessing a peripheral edge of the dial core 230, which creates a slot within which the tabs 310 are positioned. The tabs 310 have a circumferential width that is less than a circumferential width of the corresponding slot, which allows the tabs 310 to rotate within the slot to some degree. The tabs 310 may have a radial width that corresponds to a width of the recess so that when the tabs 310 are coupled with the dial core's edges 238, an outer surface of the tabs 310 roughly aligns with the outer surface of the dial core 230. In one embodiment, the knob 302 includes four tabs 310 and the dial core 230 includes four edges 238, although more or fewer tabs 310 and edges 238 may be employed as desired. The tabs 310 and edges 238 of the dial core are typically positioned immediately adjacent a corresponding pawl 240, which enables the tabs 310 to engage the pawls 240, although the position of the tabs 310 and edges 238 may be varied as desired. With the dial core 230 attached to the knob 302, the one or more pawls 240, and pawl disc 250 are sandwiched between the knob 302 and dial core 230.

The closure device 100 includes a lace exit component 160 that is separate from the housing 202 and that assembles to the housing 202. The separation of the lace exit component 160 from the housing 202 allows the lace exit component 160 to be formed of a low friction and abrasion resistant material while a high strength and impact resistant material is used for the housing 202. For example, the housing 202 may be made of a high impact material that is less abrasion resistant while the lace exit component 160 is made a high abrasion resistant material that is less impact resistant. The abrasion resistant material allows the lace exit component 160 to function with tension members that are designed to withstand higher tensile loads. The lace exit component 160 allows such tension members to repeatedly slide over surfaces of the component without experiencing excessive wearing. As illustrated in FIG. 10A, the lace exit component 160 includes a key 164 that is designed to fit within a corresponding slot 166 in the housing 202. The key 164 may be tabs that extend outward from a main body of the lace exit component 160. The lace exit component 160 may be attached to the housing 202 by positioning the lace exit component 160 below the housing and sliding the key 164 axially upward into the corresponding slot 166 in the housing 202. The lace exit component 160 includes a lace channel 162 within which the tension member is positioned so that the tension member is able to access the spool 130 within the housing 202. The lace exit component 160 is shaped and sized to correspond with the support 109 of the base member 102.

Figure 10C:
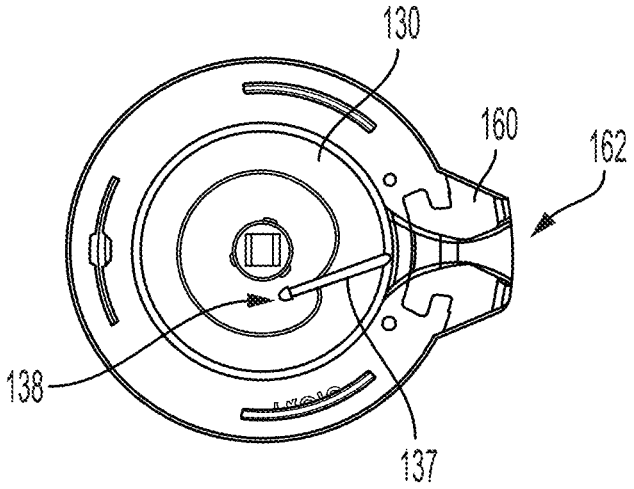
FIG. 10C illustrates a top cross-sectional view of the housing and a spool of the reel based closure device of FIG. 1.

As illustrated in FIGS. 10A-B, the coupling component 120 includes one or more lace apertures 126 that are alignable with a lace port 136 in a spool 130. Alignment of the lace aperture 126 with the spool's lace port 136 enables easy coupling of the tension member with the spool 130. For example, as illustrated in FIG. 10C, the spool 130 is alignable within the interior of the housing 202 so that a channel 137 of the spool 130 aligns with the lace channel 162 of the lace exit component 160. When the spool's channel 137 is aligned with the lace exit component's lace channel 162, a tension member may be inserted within the lace exit component's lace channel 162 and through the spool's channel 137. A distal end of the spool's channel 137 forms an opening 138, which is designed to direct the tension member downward and through the lace port 136. Insertion of the tension member through the spool's channel 137 and through the lace port 136 causes the tension member to extend outward from the bottom end of the spool 130. With the tension member extending beyond the bottom end of the spool 130, a knot may be tied in the tension member, or a separate component may be attached to the tension member, so that retraction of the tension member causes the distal end of the tension member to engage with the spool's opening 138 and prevents retraction of the tension member through the opening 138. In this manner, the tension member may be easily coupled with the spool 130.

Alignment of the coupling component's lace aperture 126 with the spool's lace port 136 allows the tension member to extend through the spool 130 and through the coupling component 120 so the knot may be tied in the tension member, or the separate component may be attached to the tension member, without requiring the coupling component 120 to be detached from the spool 130. In some embodiments, the spool 130 may include a single lace port 136 while the coupling component 120 includes a pair of lace apertures 126. This design enables a single coupling component 120 to be used with a spool 130 regardless of if the lace port 136 is positioned on a left or right hand side of the spool 130, which configuration may be employed dependent on if the spool 130 is designed to rotate in a clockwise or counterclockwise tightening direction. FIG. 10C illustrates a top cross-sectional view of the spool 130 and thus, the channel 137 is illustrated as being on an opposite side of the spool 130 from the lace port 136. The lace port 136 may be formed in the spool's channel 133 by forming a semi-circular groove in a top flange or bottom flange of the spool 130, or in both flanges of the spool 130. The semi-circular groove may guide or direct the tension member toward the opening 138 as the tension member is inserted through the lace exit component's lace channel 162.

Figure 10D:
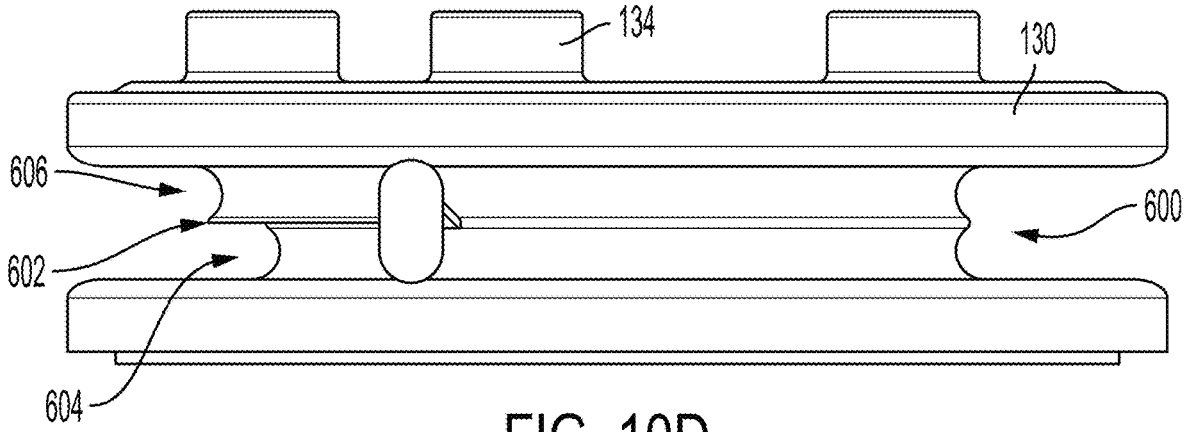
FIGS. 10D-10F illustrate an alternative spool that may be used in the reel based closure device of FIG. 1.
Figure 10E:
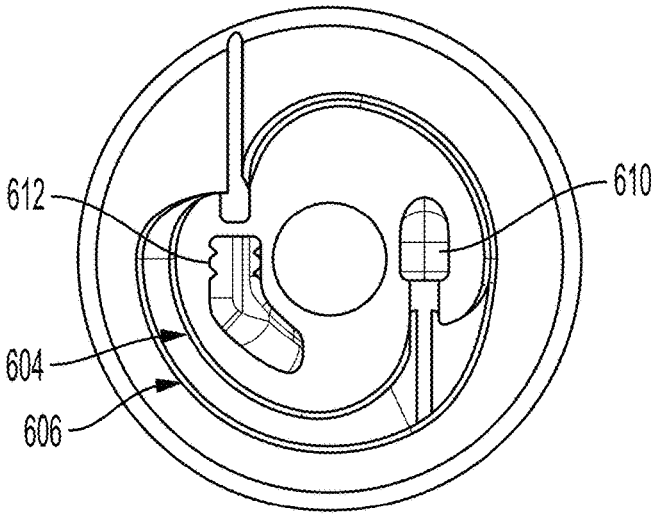
Figure 10F:
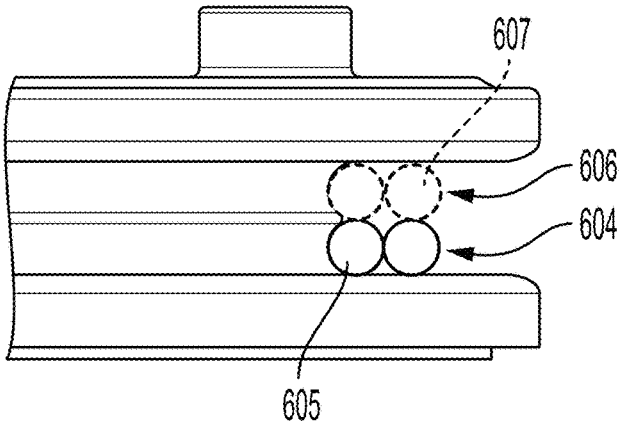

FIGS. 10D-F illustrate an alternative embodiment of a spool 130 that may be used with the reel based closure device 100. The spool 130 is designed to accommodate a thick and stiff tension member, which is used in the reel based closure device 100 to enable high tension loads to be applied. The use of a thick and stiff tension member typically requires that spool's channel 600 be arranged so that the tension member is "stacked" or wrapped around the spool in an orderly manner to avoid inconsistencies in spool capacity and/or breakage of the spool's upper or lower flanges. For example, a random wrapping of a thick and stiff tension member about the spool may exert pressure on the upper and lower flange, which may cause the spool flanges to press open and break. To avoid these issues, the spool's channel 600 is often narrow so that the thick and stiff tension member wraps about the spool in a single stack, or about a single trough. The use single stack wrapping, however, greatly minimizes the amount of tension member that may be wound or wrapped about the spool.

The spool 130 of FIGS. 10D-F enables a thick and stiff tension member to be wrapped in a double stack manner or, stated differently, to be wrapped or wound about two troughs in the spool's channel 600. To enable the double stack arrangement, the spool's channel 600 includes two troughs that are separated by a central spine or ridge 602. Specifically, the spool's channel 600 includes a first trough 604 and a second trough 606. The first trough 604 may be positioned axially below the second trough 606 as illustrated in FIG. 10D, or the position of the troughs may be reversed. The troughs, 604 and 606, are arranged so that a portion of the second trough 606 overhangs the first trough 604. The overhang is formed or defined by a portion of the first trough 604 being positioned radially inward of the second trough 606 as illustrated on the left hand side of FIG. 10D. The second trough 606 may overhang the first trough 604 by approximately the diameter of the tension member.

As illustrated in FIG. 10E, the overhang of the second trough 606 may extend roughly halfway around the spool 130. The overhang is specifically designed so that it extends from a first lace connection 610 to a second lace connection 612, which is positioned roughly halfway around the spool 130 from the first lace connection 610. The first lace connection 610 is designed to attach to a first lace 605 while the second lace connection 612 is designed to attach to a second lace 607. The connection of the first lace 605 and the second lace 607 to the respective lace connections may be the same as that described for the opening 138 and lace port 136. FIG. 10E is a cross-sectional bottom view of the spool 130 in which the first trough 604 and second trough 606 are visible. The shaded area illustrates the area of overhang between the two troughs, 604 and 606, and how far the overhang extends around the spool 130. As illustrated, the overhang has a roughly equal width around the spool's channel 600 except for near the first lace connection 610, in which the overhang is greater in order to allow the first lace 605 to gradually transition from the connection to the first trough 604. In some instances neither the first trough 604 nor the second trough 606 had a circular cross section as illustrated in FIG. 10E.

The first lace connection 610 is positioned so that the first lace 605 extends from the first lace connection 610 and is wrapped around the first trough 604. The second lace connection 612 is similarly positioned so that the second lace 607 extends from the second lace connection 612 and is wrapped around the second trough 606. The spool 130 is designed so that the first lace 605 is connected to the first lace connection 610 and the spool 130 is then rotated to connect the second lace 607 with the second lace connection 612. In rotating the spool 130 to connect the second lace 607, the first lace 605 is wrapped or wound halfway around the spool 130, and more specifically is wrapped or wound along the overhang portion of first trough 604. Stated differently, the spool 130 is designed so that the first lace 605 has an additional half wrap or half wind in comparison with the second lace 607. In some embodiments, the first lace 605 may be wrapped or wound between 170 and 200 degrees about the first trough 604 before the second lace 607 is wrapped or wound about the second trough 606.

Since the first lace 605 is wrapped or wound along the overhang portion before the second lace 607 is connected, as the spool 130 is further rotated to wrap or wind the second lace 607 about the spool's channel 600, the two laces, 605 and 607, will wind or wrap about the spool's channel in an orderly manner in which the laces, 605 and 607, are "stacked" or aligned with one another as they are wrapped about the spool 130. FIG. 10F illustrates the laces, 605 and 607, having a stacked or aligned configuration as they are wound about the respective troughs, 604 and 606, or the spool 130. Because the overhang between the troughs, 604 and 606, is roughly equal to the diameter of the first lace 605, as the first lace 605 and second lace 607 are wound around the overhang portion multiple times, the first lace 605 and second lace 607 maintain the stacked or aligned arrangement.

The stacked arrangement of the laces, 605 and 607, eliminates or minimizes any tendency of one of the laces, 605 and 607, to migrate into the other trough (or migrate to the middle of the spool channel 600) as the laces, 605 and 607, are being wound about the spool 130. In addition, the use of the stacked arrangement increases the capacity of the spool 130 to house the lace because twice as much lace may be wound about the spool 130 in comparison with a single stack spool design. The stacked arrangement further enables the laces, 605 and 607, to be simultaneously wound at a consistent radius about the spool 130. Furthermore, the stacked organization of the laces, 605 and 607, provides at least the four additional advantages: prevents jams from tangling of the lace wraps, prevent excessive loading of the spool flanges, prevent excessive wear and pressure points on the lace, and maintain the tightest wrapping of the lace, thereby improving power output.

Figure 10G:
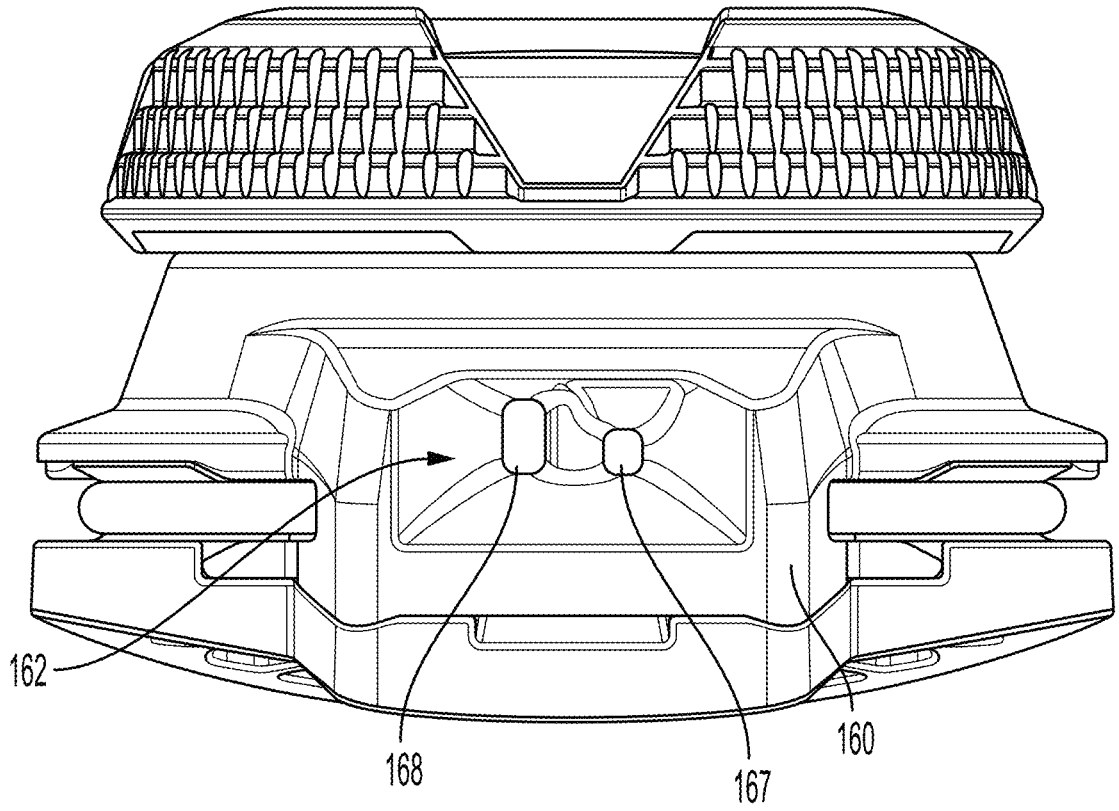
FIG. 10G illustrates an alternative lace exit component that may be used in the reel based closure device of FIG. 1.

FIG. 10G illustrates an alternative lace exit component 160 that is designed for use with the alternative spool 130 of FIGS. 10D-F. The alternative lace exit component 160 is substantially similar to the lace exit component previously described except that the lace channel 162 includes a plurality of separate apertures. Specifically, the lace channel 162 includes a first aperture 167 and a second aperture 168 that are separated by a wall or partition. The first aperture 167 is shaped, sized, and positioned so that the first lace 605 is insertable through the first aperture 167 and is able to access the first trough 604 so that a rotation of the spool 130 winds or wraps the first lace 605 about the first trough 604. Similarly, the second aperture 168 is shaped, sized, and positioned so that the second lace 607 is insertable through the second aperture 168 and is able to access the second trough 606 so that the rotation of the spool 130 winds or wraps the second lace 607 about the second trough 606.

Because the laces, 605 and 607, enter the housing 202 through separate apertures, the stacking or alignment of the laces, 605 and 607, is more easily controlled. In some instances, the first and second apertures, 167 and 168, may be different sizes and/or shapes. For example, the first aperture 167 may be smaller in size and may be positioned toward the bottom of the lace exit component 160 in order to guide or direct the first lace 605 toward the first trough 604, which is typically positioned axially below the second trough 606. The second aperture 168 may have an elongated opening in comparison to the first aperture 167 and may extend toward the top of the lace exit component 160 to allow the second lace 607 to access the second trough 606 and be easily wound or wrapped about the second trough 606. In some instances, the first and second apertures, 167 and 168, may have similar sizes, but may be positioned so that the respective lace is guided or routed into the spool's channel 600 in a desired manner.

Figure 11A:
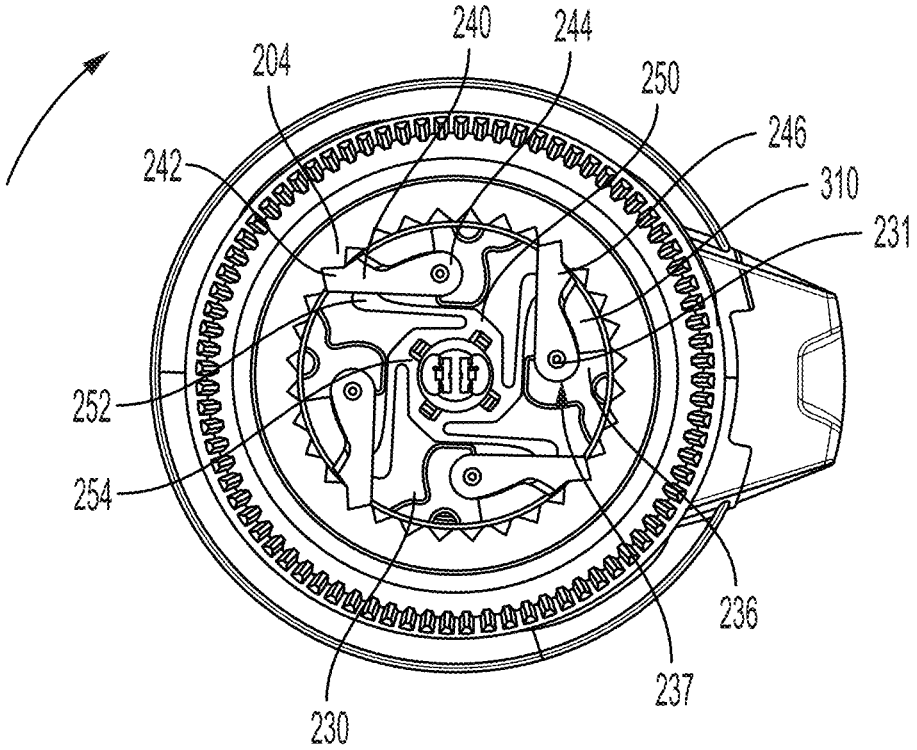
FIGS. 11A-11B illustrate a function of various components of the reel based closure device of FIG. 1 in controlling a rotation of a spool.
Figure 11B:
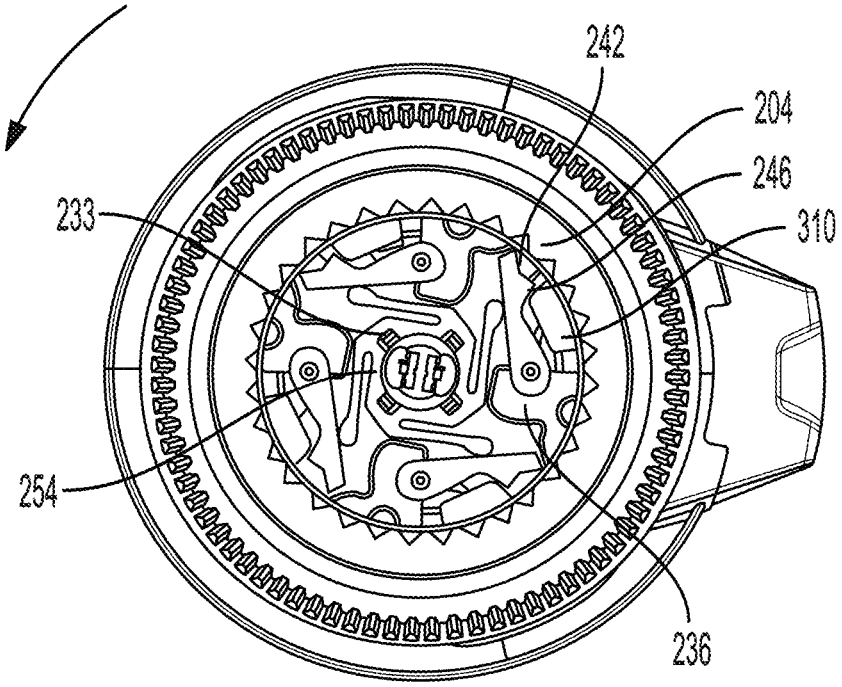

Referring now to FIGS. 11A-B, the coupling of the one or more pawls 240, the pawl disc 250, and the dial core 230 is illustrated. The function of the one or more pawls 240, pawl disc 250, and knob 302 in controlling the rotation of the spool 130 is also illustrated. To facilitate in coupling the one or more pawls 240 with the dial core 230, the dial core 230 includes one or more drive bosses 236 that extend axially upward from a top surface of the dial core 230. Each drive boss 236 includes a recess 237 that is shaped and sized to accommodate a proximal end 244 of the one or more pawls 240. The recess 237 is designed so that each pawl 240 is able to rotate in a clockwise and counterclockwise direction atop the dial core 230. In a specific embodiment, the recess 237 and the proximal end 244 of the pawl 240 are each semi-circular in shape. The proximal end 244 of the pawl 240 may engage or contact a wall of the recess 237 so that forces or loads exerted on the pawl 240 are transferred to the drive boss 236. In this manner, each drive boss 236 supports and reinforces a corresponding pawl 240.

The dial core 230 also includes one or more pivot bosses 231 that extend axially upward from the top surface of the dial core 230. Each pivot boss 231 couples with a corresponding pawl 240 by inserting the pivot boss 231 within an aperture positioned on the proximal end of the corresponding pawl 240. Coupling of a pawl 240 with a pivot boss 231 enable the pawl 240 to pivot or rotate about the pivot boss 231. In some embodiments, the one or more pawls 240 may be integrated with the dial core 230. In such embodiments, the one or more pawls 240 are typically configured so that they are moveable or rotatable about the dial core 230. For instance, the one or more pawls 240 may be compliant mechanisms and/or may be coupled with one or more compliant members or mechanisms.

The pawl disc 250 is coupled with the dial core 230 by aligning recesses 254 of the pawl disc 250 with corresponding keyed protrusions 233 of the dial core 230. The pawl disc 250 may then be pressed downward atop the dial core 230 so that the keyed protrusions 233 snap into the corresponding recesses 254. In some embodiments, the pawl disc 250 may be integrated with the dial core 230 and/or one or more pawls 240. In such embodiments, the pawl disc 250 should be configured to bias the one or more pawls 240 outward as described herein. Separation of the one or more pawls 240, pawl disc 250, and/or dial core 230 allows each component to be made of a different material, which may enable the components to be optimized for a particular purpose. For example, the one or more pawls 240 may be made of a high stiffness material that is able withstand higher forces while a soft spring like material is used for the pawl disc 250 to actuate or bias the one or more pawls 240. The dial core 230 may be made of a material that is suited for supporting and reinforcing the pawl disc 250 and one or more pawls 240.

The pawl disc 250 includes one or more arms 252 that extends outward from a main body of the pawl disc 250. The one or more arms 252 are flexible and are positioned atop the dial core 230 so that a distal end of each arm 252 is positioned against a rear surface of a corresponding pawl 240. The arms 252 are configured to provide a biasing force that presses or biases the pawls 240 toward engagement with the teeth 204 that are formed on, or otherwise coupled with, the housing 202. More specifically, the arms 252 bias the pawls 240 so that the pawls rotate about the pivot bosses 231 into engagement with the teeth 204. In this manner, the pawl disc 250 functions as a spring that presses or biases the pawls 240 toward engagement with the teeth 204.

Each pawl 240 includes one or more teeth 242 that are positioned on a distal end of the pawl 240. The one or more teeth 242 are shaped and sized so that they are engageable with the teeth 204 of the closure device 100. More specifically, the one or more teeth 242 are shaped and sized so that they are able to fit within a tooth, or within teeth, of the closure device 100. Engagement of the one or more pawls' teeth 242 and the closure device's teeth 204 prevents rotation of the dial core 230 in the loosening direction (e.g., counterclockwise in FIG. 11A). Specifically, when the pawls 240 are engaged with the teeth 204 and a force is applied to the dial core 230 in the loosening direction (via the tension member and spool 130), the one or more pawls 240 are oriented and coupled with the dial core 230 in a manner that does not allow the one or more pawls 240 to rotate. As such, the one or more pawls 240 remain engaged with the teeth 204, which prevents rotation of the dial core 230 in the tightening direction.

The spool 130 is prevented from rotating in the loosening direction due to the engagement of the dial core 230 with the clutch plate 220, drive component 150, and spool 130 as described herein. Due to the biasing force of the pawl disc 250, the pawls 240 remain engaged with the teeth 204 until the pawls 240 are moved out of engagement with the teeth 204 due to upward movement of the dial core 230 or rotation of the knob 302 in the loosening direction. In addition, the biasing force of the pawl disc 250 causes the one or more pawls 240 to automatically reengage the teeth 204 when the dial core 230 is moved axially downward or when rotation of the knob 302 in the loosening direction is ceased.

To rotate the spool 130 in the tightening direction, the tabs 310 are configured to engage the drive boss 236 of the dial core. Specifically, the tabs 310 extend axially downward from the knob 302 and are positioned so that when the knob 302 is coupled with the housing 202 in the engaged position, each tab 310 is adjacent a drive boss 236 and is between a pawl 240 and the teeth 204. As illustrated in FIG. 11A, when the knob 302 is rotated in the tightening direction (e.g., clockwise in FIG. 11A), a proximal end of each tab 310 contacts a distal surface of a drive boss 236. Engagement of the tabs 310 and drive bosses 236 causes rotational forces to be transferred from the knob 302 to the dial core 230 as the knob 302 is rotated in the tightening direction, which causes the dial core 230 to rotate in the tightening direction. Rotation of the dial core 230 in the tightening direction causes the spool 130 to also rotate in the tightening direction due to engagement of the dial core 230 clutch plate 220, drive component 150, and spool 130 as described herein. The orientation of the one or more pawls 240 atop the dial core 230 causes the one or more pawls 240 to deflect inward and skip over the teeth 204 as the dial core 230 is rotated in the tightening direction. The pawl disc 250 causes the one or more pawls 240 to spring outward as the one or more pawls 240 skip over the teeth 204.

The tabs 310 are further configured to allow the dial core 230 to be incrementally rotated in the loosening direction. Specifically, as the knob 302 is rotated in the loosening direction (e.g., counterclockwise in FIG. 11B), each tab 310 rotates within the interior of the housing 202 so that a distal surface of each tab 310 contacts and engages the distal end of a corresponding pawl 240. Further rotation of the knob 302 in the loosening direction causes the tab 310 to push, pivot, or rotate the corresponding pawl 240 out of engagement with the teeth 204. Disengagement of the one or more pawls 240 and the teeth 204 momentarily unlocks the dial core 230 from the housing 202, which allows the dial core 230 to momentarily or incrementally rotate in the loosening direction responsive to a force in the loosening direction from the spool 130 and tension member. More specifically, tension loads or forces in the tension member are imparted on the spool 130, which are transferred to the clutch plate 220 and dial core 230 due to the engagement of those components with the spool 130. The tension loads cause the dial core 230 to rotate in the loosening direction when the dial core 230 is unlocked from the housing 202.

As the dial core 230 rotates in the loosening direction, each tab 310 disengages a corresponding pawl 240 and pivots or rotates back into engagement with the teeth 204 due to the biasing force from the pawl disc 250. The one or more pawls 240 remain engaged with the teeth 204 until further rotation of the knob 302 in the loosening direction causes the tabs 310 to push, pivot, or rotate the pawls 240 out of engagement with the teeth 204 again. In this manner, the dial core 230 and spool 130 may be incrementally rotated in loosening direction to loosen or lessen the tension in the tension member.

The incremental engagement and disengagement of the pawls 240 and tabs 310 to enable rotation of the spool 130 and dial core 230 in the loosening direction may be referred to as "sweeping" the pawls 240 out of engagement with the teeth 204. To facilitate in "sweeping" the pawls 240 out of engagement with the teeth 204, each pawl 240 may include an nub or tab 246 that extends slightly outward from a surface of the pawl 240. The distal end of each tab 310 may also include an angled or ramped surface. The angled or ramped surface of each tab 310 engages with the nub or tab 246 of each pawl 240 and applies a gradually increasing force to the pawl 240, which reduces stress and wear on the two components. In some embodiments, the angled or ramped surface may only be formed on an upper portion of each tab 310. In such embodiments, the lower portion of each tab 310 may include the radially inward lip 312 that is shaped and sized to fit under a corresponding edge 238 of the dial core 230.

The degree or amount of each loosening step may be equivalent to a distance between each tooth 204 or a distance between multiple teeth as desired. As described herein, when the tension in the tension member is near the tension threshold, the clutch plate 220 will slide downward and into engagement with the annular ring 206, which prevents further rotation of the clutch plate 220, drive component 150, and spool 130. When the clutch plate 220 engages with the annular ring 206, further rotation of the dial core 230 and knob 302 in the loosening direction is possible due to the configuration of the dial core 230 and clutch plate 220.

In the illustrated embodiment, the closure device 100 may include four pawls 240, four tabs 310, and four arms 252. This configuration may be ideal for generating high torque and accommodating high tension loads. In other embodiments, more or fewer components may be employed based on a particular application or need, or based on a desired torque output.

Figure 12:
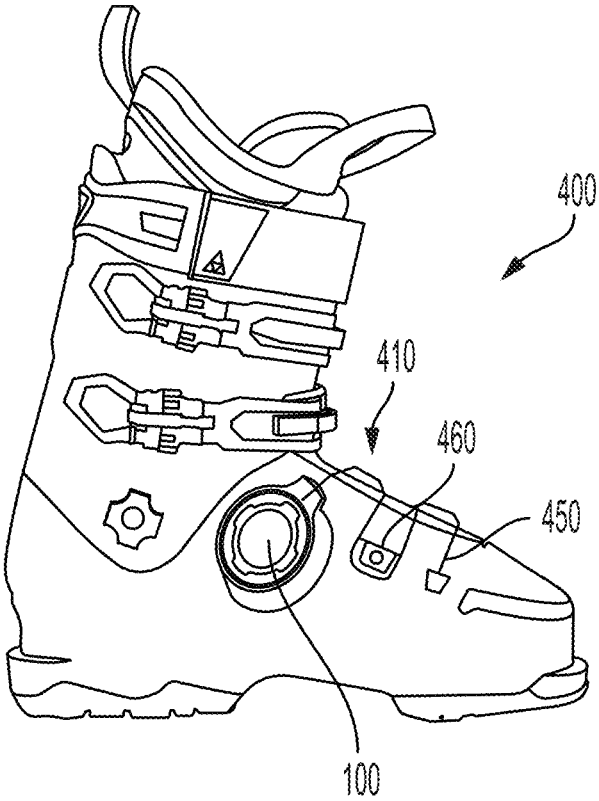
FIG. 12 illustrates a ski boot having the reel based closure device of FIG. 1.
Figure 13:
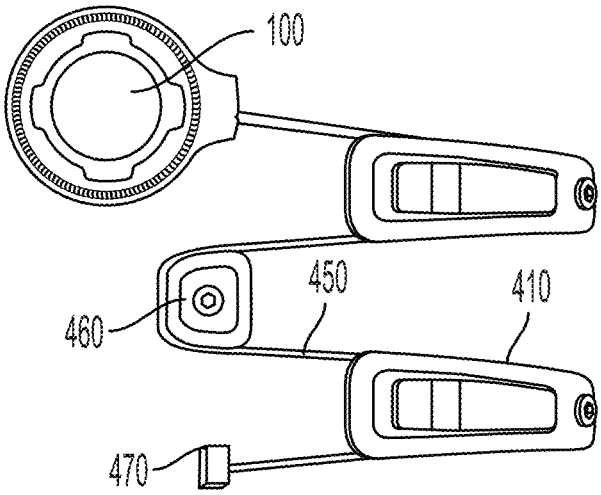
FIG. 13 illustrates a lace path and guide configuration that may be employed on the ski boot of FIG. 12.

Referring now to FIG. 12, illustrated is a ski boot 400 that includes the closure device 100 described above. The closure device 100 may be ideal for tensioning the ski boot 400 since it is able to output high torque and generate high tension loads, which are typically required to close and tighten a ski boot about a user's foot. The ski boot 400 includes a unique long guide 410 that is designed to accommodate high tension loads and facilitate in closing and tightening of the ski boot's shell. The long guide 410 is illustrated in greater detail in FIGS. 14A-C. FIG. 13 illustrates a lace path and guide configuration that may be employed on the ski boot 400 of FIG. 12. Specifically, the guide configuration includes a plurality of long guides 410 and one or more shorter guides 460 that are positioned between a pair of long guides 410. The closure device 100 is positioned at a top of the lace path and a tension member 450 is routed from the closure device 100 along the lace path via the plurality of long guides 410 and the one or more shorter guides 460. The tension member 450 terminates at a distal end of the lace path via a terminal member or terminating end component 470. The termination of the distal end of the tension member 450 enables the closure device 100 to generate greater tension forces in the tension member 450.

The lace path may extend across an opening between two shells of the ski boot 400. In some embodiments, the plurality of long guides 410 may be positioned on one shell while the one or more shorter guides 460 are positioned on an opposite shell. The one or more shorter guides 460 may be riveted or mechanically fastened to the ski boot 400 while a distal end of the longer guides 410 is attached to the ski boot. The one or more shorter guides 460 may have an open channel or end within which the tension member 450 is positioned while the longer guides 410 include a closed channel through with the tension member 450 is positioned. The tension member may be removed or withdrawn from the open channel of the one or more shorter guides 460 to allow the ski boot 400 to be more easily removed from about the foot.

Figure 14A:
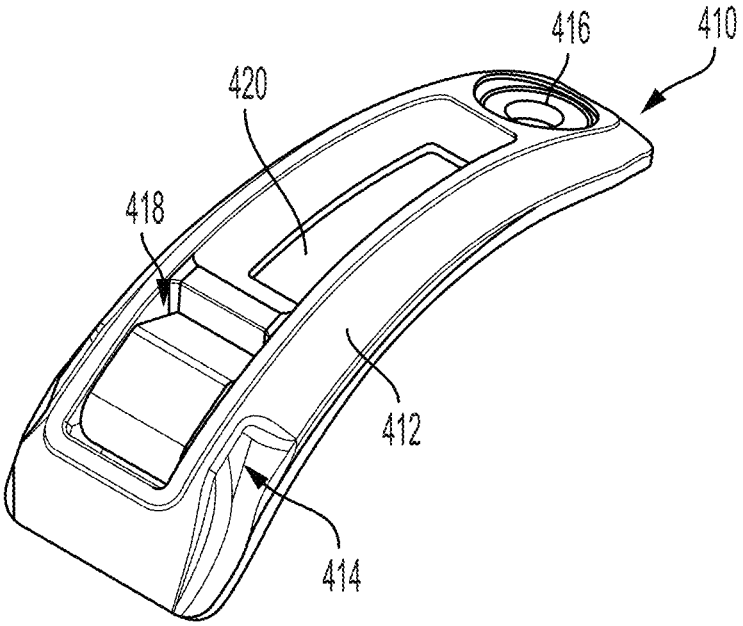
FIGS. 14A-14C illustrate a long guide that may be employed on the ski boot of FIG. 12.
Figure 14B:
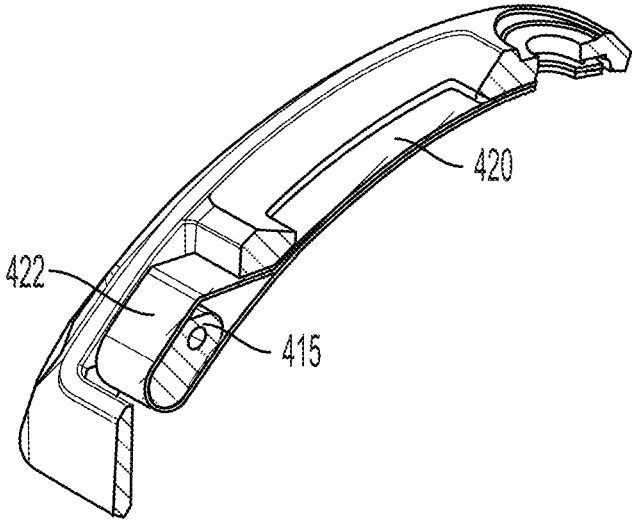
Figure 14C:
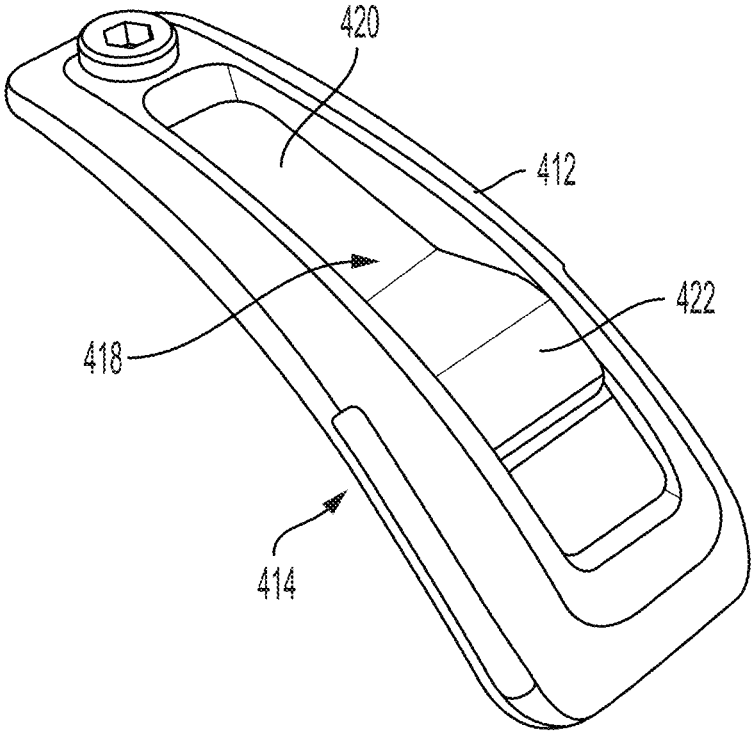

Referring to FIGS. 14A-C, the longer guide 410 is made of multiple components. Specifically, the longer guide 410 includes an exterior shell or body 412 and a reinforcement component 420. The exterior shell 412 houses the reinforcement component 420. The longer guide 410 enables the guide to be attached on a side of the ski boot 400, typically near a sole of the ski boot, while the distal end that engages the tension member 450 is positioned closure to an opening of the ski boot 400. This configuration helps the guide 410 wrap over the shell and facilitates in properly closing the shell about the foot.

The reinforcement component 420 enables the guide 410 to withstand high tension loads without breaking or cracking. The reinforcement component 420 also enables the exterior shell 412 to be made of a low friction material, which may not be able to withstand the tension forces that are imparted on the tension member 450. The exterior shell 412 and reinforcement component 420 each extend from a proximal end of the guide 410 to a distal end of the guide 410. A proximal end of the exterior shell 412 and reinforcement component 420 include an aperture 416 that allows a rivet or other mechanical fastener to attach the guide 410 to the ski boot 400. The reinforcement component 420 is formed of a material strip that extends from the proximal end to the distal end of the guide 410. The material strip may be made of a metal material, such as aluminum, or another material that is able to withstand high tensile loads, such as a fabric material, carbon fiber material, rigid polymer material, and the like.

The material strip is folded to form a looped end 422. The folded material strip results in the reinforcement component 420 having an upper and lower segment that each extend from the looped end 422 to the proximal end of the guide. The upper and lower segments may each include the aperture 416 and may each be coupled with the ski boot shell. The upper and lower segments are typically positioned in contact with one another from the proximal end to the looped end 422 of the reinforcement component 420, although in some embodiments, the upper and lower segments may be separated by the exterior shell 412 or another material.

The exterior shell 412 includes a guide segment 415 that is disposed within the looped end 422 of the reinforcement component 420. The guide segment 415 extends between opposing sides of the exterior shell 412. The distal end of the exterior shell and the guide segment 415 include a channel 414 through which the tension member 450 is positioned. The guide segment 415 is made of a lower friction material than the reinforcement component 420, which minimizes frictional engagement of the guide 410 and tension member. When the guide 410 is tensioned by the tension member 450, the guide segment 415 presses against the looped end 422 of the reinforcement component 420. In this manner, some or all of the tension load in the guide segment 415 is transferred from the exterior shell 412 to the reinforcement component 420, which is better able to handle the high tension loads that are generated from the closure device 100. The tension in the looped end 422 is transferred to the proximal end of the guide 410 via the upper and lower segments of the reinforcement component's material strip and is ultimately transferred to the shell of the ski boot 400 due to the mechanical fastener anchoring the long guide 410 to the shell. The tension forces pull the opposing shells together and pull the ski boot closed over the user's foot. The long guide 410 is also pressed downward atop the shell, which further closes and tightens the shell about the user's foot.

The exterior shell 412 commonly surrounds the reinforcement component 420. For example, the exterior shell 412 may cover the opposing sides of the reinforcement component 420, although in other embodiments one or both sides of the reinforcement component 420 may be exposed. The exterior shell 412 may also include a distal most end that is positioned distally of the looped end 422. The distal most end of the exterior shell 412 may allow the tension member 450 to transition into and out of the channel 414 in a minimal frictional manner. For example, opposing sides of the exterior shell's distal most end may be arcuate or curved and provide a smooth transition radius that eliminates sharp corners that may damage the tension member 450 or cause undue pressure on the guide segment 415 and/or looped end 422. In some embodiments, the opposing sides of the exterior shell's distal most end may have a radius of between 40 and 50 mm to provide a smooth transition for the tension member 450. The distal most end may also cover the looped end 422 and prevent the looped end from contacting surrounding objects.

In some embodiments, the exterior shell 412 may include one or more openings 418 through which the reinforcement component 420 is visible. For example, in the illustrated embodiment, the exterior shell 412 includes two open section through which the looped end 422 and upper segment are visible. The distal most open section may enable the reinforcement component 420 to be easily coupled with the exterior shell 412 by allowing the upper and lower segments to be separated and placed around the guide segment 415. The upper and lower segments may then be moved proximally until the looped end 422 is positioned around the guide segment 415. In other embodiments, the looped end 422 and/or upper and lower segments may be covered by the exterior shell 412 so that the reinforcement component 420 is not visible. The upper and lower segments may also be positioned on a bottom end or surface of the exterior shell 412 so that the lower segment contacts the shell of the ski boot 400. In other embodiments, the upper and lower segments may be disposed or enclosed within the exterior shell 412 as desired.

The exterior shell 412 may include a pair of openings 418 that are separated by a material bridge as illustrated in FIGS. 14A-B, or the exterior shell 412 may include a single opening 418 as illustrated in FIG. 14C. The material bridge that separates the pair or openings may function to keep the upper and lower segments of the reinforcement component 420 in contact. In some embodiments, the long guide 410 may have a length of between 40 and 80 mm and more commonly a length of between 50 and 70 mm. The long guide may likewise have a width of between 15 and 35 mm and more commonly a width of between 20 and 30 mm. In a specific embodiment, the long guide may have a length of approximately 60 mm and a width of approximately 25 mm. The long guide 410 may be curved about its longitudinal length to help the long guide engage and contact an upper surface of the ski boot's shell. The shorter guide 460 may have a width that corresponds to the width of the long guide and a length that is shorter than the width of the shorter guide 460. The shorter guide 460 may not require a reinforcement component since the mechanical fastener is positioned distally of the tension member 450.

Referring to FIGS. 15A-E, illustrated is an embodiment of a terminal member or terminating end component 470 (hereinafter terminal member 470) that is designed to attach to the distal end of the tension member 450 and to attach to the ski boot 400, or any other article, in order to fixedly couple or attach the tension member 450 to the ski boot 400 or article. For ease in describing the terminal member 470, reference will be made to the terminal member 470 attaching to a ski boot 400, although it should be recognized that the terminal member 470 may be coupled with any desired article.

The terminal member 470 is able to attach and detach from the ski boot 400, which enables the terminal member 470 to be quickly and easily replaced if the tension member 450 fails, or for any other reason. The terminal member 470 includes a main body 502 having an inner cavity 510 and thru hole 508. The thru hole 508 is positioned on a proximal end of the main body 502 and is shaped and sized so that a bolt 480 or other mechanical fastening device may be inserted through the thru hole 508 and attached to the ski boot 400. An upper portion of the thru hole 508 may be recessed from an upper surface of the main body 502. The recessed portion of the thru hole 508 may have a wider diameter than the remainder of the thru hole 508 to allow the bolt 480 to be recessed relative to the upper surface of the main body 502 and thereby reduce a profile of the terminal member 470 when attached to the ski boot 400.

The main body 502 also includes a lace port or aperture 504 through which the tension member 450 is inserted as described herein below. The lace aperture 504 is positioned on a distal end of the main body 502 opposite the thru hole 508. When the terminal member 470 is attached to the ski boot 400, the lace aperture 504 is positioned so that an opening of the lace aperture 504 faces the lace path of the tension member 450. The main body 502 further includes an aperture 506 that enables a tool (not shown) to access a lock component 550 that is positioned within the cavity 510 of the main body 502. The tool, which may be a screw driver or other device, is insertable within the aperture 506 to engage the lock component 550 and induce a locking force on the tension member 450 or release the locking force that is induced on the tension member 450. The locking force that is imparted or exerted on the tension member 450, via the lock component 550, is sufficient to lock, or fixedly attach, the tension member 450 to the terminal member 470. The aperture 506 is typically positioned on a sides of the main body 502 roughly perpendicular to the lace aperture 504; however, the aperture 506 may be positioned elsewhere about the main body 502 as desired. Positioning of the aperture 506 on the side of the main body 502 roughly perpendicular to the lace aperture 504 may be preferred because it allows the user to easily access the aperture 506 when the terminal member 470 is fixedly secured to the ski boot 400, via bolt 480, without interference by the tension member 450 or other components of the ski boot 400.

Figure 15A:
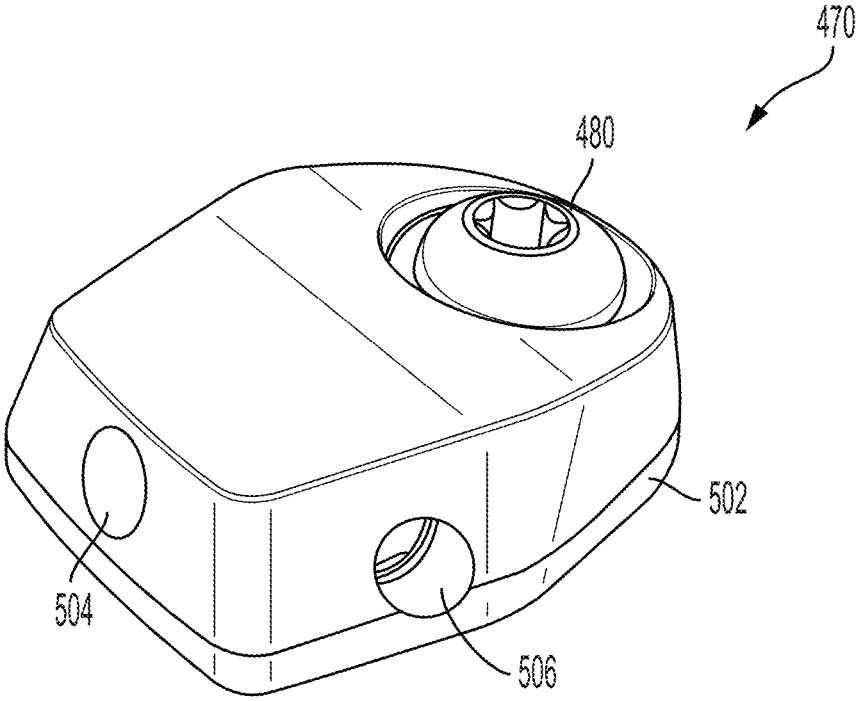
FIGS. 15A-15E illustrate a terminal member that may be employed on the ski boot of FIG. 12.
Figure 15B:
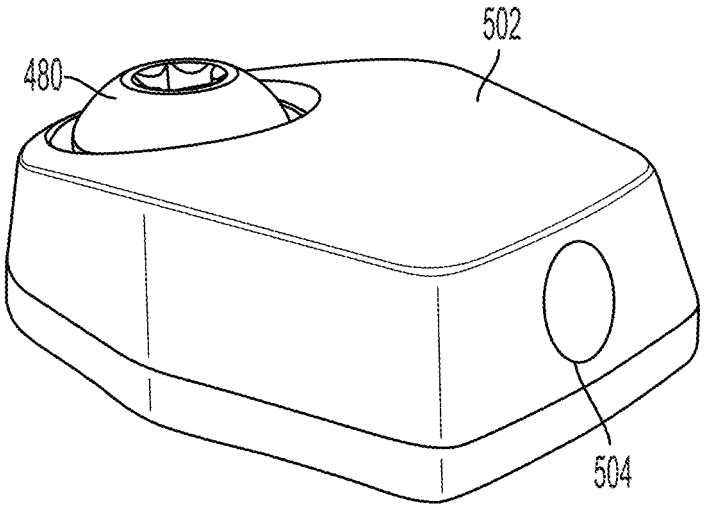
Figure 15C:
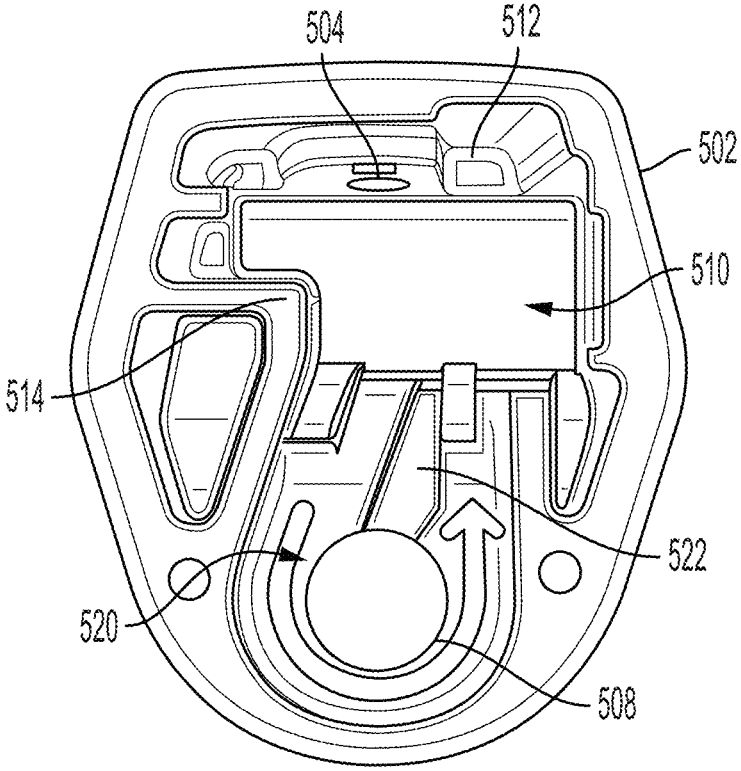

FIG. 15C illustrates a bottom view of the terminal member 470. The cavity 510 formed in the main body 502 is evident in FIG. 15C. In some embodiments, the cavity 510 has an L-shaped configuration to prevent the lock component 550 from being inserted within the cavity 510 in an incorrect orientation. Specifically, the main body 502 includes an elbow 514 that protrudes into a corner or portion of the cavity 510 so that the cavity 510 has an L-shaped profile when viewed from a bottom end, as in FIG. 15C. A secondary cavity 512 is also defined in the bottom portion of the main body 502 near the lace aperture 504. The secondary cavity 512 extends from the cavity 510 and forms a small pocket or recess in the distal end of the main body 502. As described herein below, the distal end of the tension member 450 is positioned within the secondary cavity 512 when the tension member is coupled with the terminal member 470 and lock component 550.

A channel 520 is formed in the proximal end of the main body 502. The channel 520 extends from the cavity 510 and around the thru hole 508. The channel 520 is shaped and sized to correspond with a diameter of the tension member 450. More specifically, the channel 520 has a width and depth that is greater than the diameter of the tension member 450, which allows the tension member 450 to be fully positioned within the channel 520 and wrapped around the bolt 480 that is positioned through the thru hole 508. In some embodiments, a wall 522 extends from the cavity 510 to the thru hole 508, or adjacent to the thru hole 508, in order to divide a distal portion of the channel 520 between the cavity 510 and thru hole 508 into first and second sections (shown in FIG. 15E as separate channels positioned laterally adjacent one another). The wall 522 may function to route or guide the tension member 450 as it is inserted through the channel 520 and lock component 550. In some embodiments, an arrow or other symbol may be formed on a surface of the channel 520. In the illustrated embodiments, the arrow is formed in the channel 520 around the thru hole 508. The arrow may visibly indicate a direction that the tension member 450 is to be routed through the lock component 550 and channel 520.

FIG. 15C illustrates the lock component 550 positioned within the cavity 510 of the terminal member 470. The lock component 550 may include an L-shaped profile that mirrors the L-shaped profile of the cavity 510. Specifically, an elbow 559 may be formed in the lock component 550 that matches the elbow 514 of the cavity 510 to enable the lock component 550 to be inserted within the L-shaped cavity 510. The L-shaped cavity 510 and lock component 550 ensures that the lock component 550 is always properly or correctly inserted within the cavity 510 by preventing the lock component 550 from being inserted within the cavity 510 unless it is properly oriented and aligned with the cavity 510. Proper and correct insertion of the lock component 550 may be important to ensure that the tension member 450 is insertable through the lock component 550 in a manner that does not kink or damage the tension member 450. For example, the lock component 550 includes a lace entry aperture 552 that coaxially aligns with the lace aperture 504 of the main body 502 when the lock component 550 is inserted within the cavity 510. If the lock component 550 is not properly inserted within the cavity 510, the lace entry aperture 552 may be misaligned with the lace aperture 504 of the main body 502, which may kink or damage the tension member 450 upon tensioning of the tension member 450 or assembly of the terminal member 470 about the ski boot 400.

The lace entry aperture 552 is formed on a distal side of the lock component 550. A lace exit aperture 554 is formed on a proximal side of the lock component 550 opposite the lace entry aperture 552. A channel or lumen extends between the lace entry aperture 552 and the lace exit aperture 554, which enables the tension member to be inserted fully through the lock component 550 between the lace entry aperture 552 and the lace exit aperture 554. When the lock component 550 is positioned within the cavity 510, the lace exit aperture 554 aligns with a first section of the channel 520.

A second lace entry aperture 556 is formed on the proximal side of the lock component 550 while a second lace exit aperture 558 is formed on the distal side of the lock component 550 opposite the second lace entry aperture 556. When the lock component 550 is positioned within the cavity 510, the second lace entry aperture 556 is aligned with a second section of the channel 520 while the second lace exit aperture 558 is aligned with the secondary cavity 512. A channel or lumen extends between the second lace entry aperture 556 and the second lace exit aperture 558, which enables the tension member to be inserted fully through the lock component 550 between the second section of the channel 520 and the secondary cavity 512.

Figure 15D:
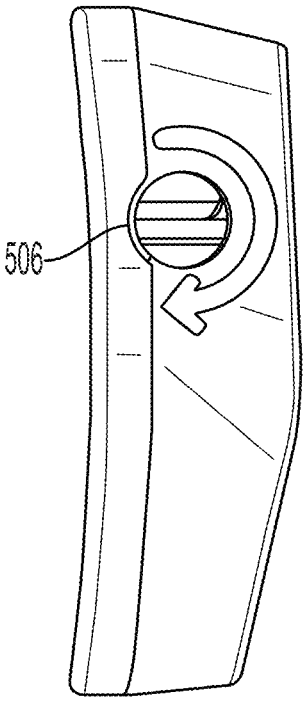
Figure 15E:
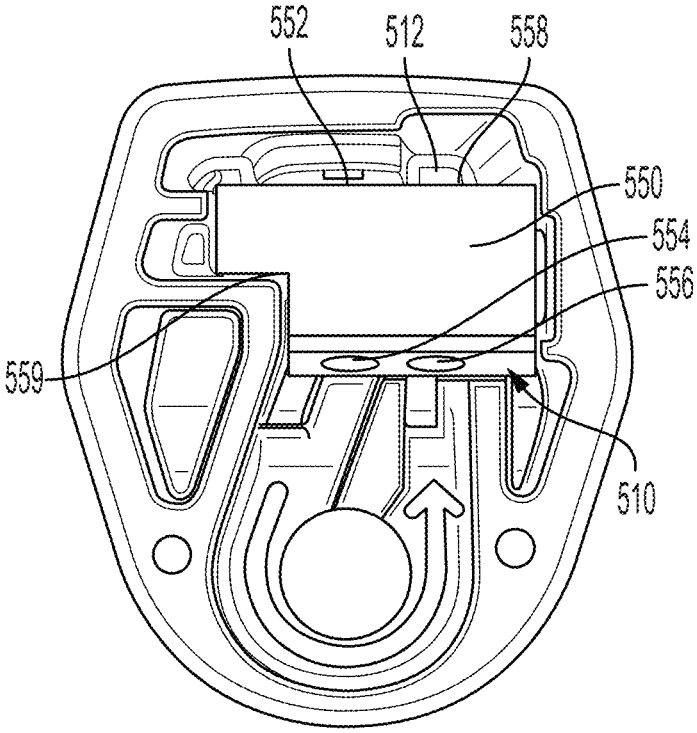

FIG. 15D illustrates a side view of the main body 502 and, more specifically, illustrates the tool access aperture 506. The aperture 506 is formed in the main body 502 so that it extends from the cavity 510 to an exterior surface of the main body 502. As briefly described above, a tool may be inserted through the aperture 506 to engage the lock component 550 positioned within the cavity 510 of the main body. The tool may be used to lock or unlock the tension member 450 from engagement with the lock component 550, which fixedly couples the tension member 450 to the terminal member 470 or releases the tension member 450 therefrom. In a specific embodiment, the tool may access a set screw (not shown) that is threaded into a main body of lock component 550. The tool may rotate the set screw into increased or decreased frictional engagement with the tension member 450. The set screw may exert a clamping or compressional force on the tension member 450 to lock the tension member 450 within the main body of the lock component 550 and thereby fixedly attach the tension member 450 to the terminal member 470. More specifically, rotation of the set screw may move the set screw toward or away from the channel or lumen between the second lace entry aperture 556 and the second lace exit aperture 558, which may compress the tension member 450 within this channel or lumen. In some embodiments, a component or material, such as a nylon patch, may be positioned between the tension member 450 and the distal end of the set screw in order to minimize or eliminate unwanted damage to the tension member 450 from the set screw.

To fixedly couple or secure the tension member 450 with the lock component 550, the tension member 450 is inserted through the lace aperture 504 of the main body 502 and through the lace entry aperture 552 of the lock component 550. The tension member 450 is then inserted through the channel between the lace entry aperture 552 and lace exit aperture 554 until the tension member 450 extends from the lace exit aperture 554. The tension member 450 is then curved around the thru hole 508 within the channel 520 following the arrow formed or defined on the surface of the channel 520. In some embodiments, the wall 522 may be angled to help guide or deflect the tension member 450 toward the channel 520 upon exiting the lace exit aperture 554. The tension member 450 is then inserted through the second lace entry aperture 556 and through the respective channel until the tension member 450 extends from the second lace exit aperture 558. Upon exiting the second lace exit aperture 558, the distal end of the tension member 450 is positioned within the secondary cavity 512. The set screw may then be engaged, via the tool inserted through the tool access aperture 506, to lock the tension member 450 within the lock component 550. Detachment of the tension member 450 from the lock component 550 may be achieved by accessing the set screw, via the tool inserted through the tool access aperture 506, and rotating the set screw toward an unlocked position. The tension member 450 may then be removed from the lock component 550 and terminal member 470. All of the above processes may be performed while the terminal member 470 is attached to a ski boot 400.

While several embodiments and arrangements of various components are described herein, it should be understood that the various components and/or combination of components described in the various embodiments may be modified, rearranged, changed, adjusted, and the like. For example, the arrangement of components in any of the described embodiments may be adjusted or rearranged and/or the various described components may be employed in any of the embodiments in which they are not currently described or employed. As such, it should be realized that the various embodiments are not limited to the specific arrangement and/or component structures described herein.

In addition, it is to be understood that any workable combination of the features and elements disclosed herein is also considered to be disclosed. Additionally, any time a feature is not discussed with regard in an embodiment in this disclosure, a person of skill in the art is hereby put on notice that some embodiments of the invention may implicitly and specifically exclude such features, thereby providing support for negative claim limitations.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A reel based closure device for tensioning a tension member, the reel based closure device comprising:

a housing that defines a vertical axis;

a plurality of first teeth operably coupled with the housing;

a spool rotatably positioned within the housing;

a pawl member that is rotatable relative to the housing, the pawl member including one or more pawl teeth that are engageable with the plurality of first teeth to enable a rotation of the spool in a first direction while preventing a rotation of the spool in a second direction;

a plurality of second teeth operably coupled with the housing;

a planetary gear of a gear mechanism comprising gear teeth that engage with the plurality of second teeth during a rotation of the spool within the housing; and a dial or knob that is operably coupled with the spool so that a rotation of the dial or knob effects the rotation of the spool in the first direction within the housing to thereby wind the tension member about the spool;

wherein the pawl member is separable from the housing and from the dial or knob;

wherein a length of each tooth of the plurality of second teeth is substantially longer than a length of each tooth of the gear teeth; and wherein the one or more pawl teeth are axially moveable to disengage from the plurality of first teeth.

2. The reel based closure device of claim 1, wherein the length of each tooth of the plurality of second teeth is between 30% and 60% longer than the length of each tooth of the gear teeth.

3. The reel based closure device of claim 1, wherein the plurality of second teeth is a ring gear of the gear mechanism.

4. The reel based closure device of claim 1, wherein an upper flange of the spool includes an annular recess or lip that is shaped and sized to accommodate the plurality of second teeth.

5. The reel based closure device of claim 1, wherein a bottom or distal end of each tooth of the plurality of second teeth extends below a bottom or distal end of each tooth of the gear teeth.

6. A method of manufacturing a reel based closure device, the method comprising:

providing a reel based closure device that includes:

a housing defining a vertical axis;

a plurality of first teeth operably coupled with the housing;

a spool rotatably positioned within the housing;

a pawl that is rotatable about the vertical axis, the pawl including one or more teeth that are engageable with the plurality of first teeth;

a plurality of second teeth; and a dial or knob that is operably coupled with the spool so that a rotation of the dial or knob effects the rotation of the spool within the housing;

positioning a planetary gear in operable engagement with the plurality of second teeth, the planetary gear including gear teeth that engage with the plurality of second teeth;

wherein the pawl is separable from the housing and from the dial or knob;

wherein a length of each tooth of the second teeth is substantially longer than a length of each tooth of the gear teeth; and wherein the one or more teeth of the pawl are axially moveable to disengage from the plurality of first teeth.

7. The method of claim 6, wherein the length of each tooth of the second teeth is between 30% and 60% longer than the length of each tooth of the gear teeth.

8. The method of claim 6, wherein the plurality of second teeth is a ring gear.

9. The method of claim 6, wherein an upper flange of the spool includes an annular recess or lip that is shaped and sized to accommodate the plurality of second teeth.

10. The method of claim 6, wherein a bottom or distal end of each tooth of the plurality of second teeth extends below a bottom or distal end of each tooth of the gear teeth.

11. A reel based closure device comprising:

a housing;

a plurality of first teeth;

a spool rotatably positioned within the housing;

a pawl that is rotatable relative to the housing, the pawl including one or more teeth that are engageable with the plurality of first teeth;

a plurality of second teeth;

a planetary gear comprising gear teeth that engage with the plurality of second teeth; and a dial or knob that is operably coupled with the spool so that a rotation of the dial or knob effects the rotation of the spool within the housing;

wherein the pawl is separable from the housing and from the dial or knob;

wherein a length of each tooth of the plurality of second teeth is substantially longer than a length of each tooth of the gear teeth; and wherein the one or more teeth of the pawl are axially moveable to disengage from the plurality of first teeth.

12. The reel based closure device of claim 11, wherein the length of each tooth of the plurality of second teeth is between 30% and 60% longer than the length of each tooth of the gear teeth.

13. The reel based closure device of claim 11, wherein the plurality second of teeth is a ring gear.

14. The reel based closure device of claim 11, wherein an upper flange of the spool includes an annular recess or lip that is shaped and sized to accommodate the plurality of second teeth.

* * * * *